US007760588B2

(12) United States Patent
Takada

(10) Patent No.: US 7,760,588 B2
(45) Date of Patent: Jul. 20, 2010

(54) RADIO CONTROLLED TIME PIECE AND METHOD OF CONTROLLING SAME

(75) Inventor: Akinari Takada, Tokyo (JP)

(73) Assignee: Citizen Holdings Co., Ltd., Tokyo (JP)

( * ) Notice: Subject to any disclaimer, the term of this patent is extended or adjusted under 35 U.S.C. 154(b) by 0 days.

(21) Appl. No.: 10/589,414

(22) PCT Filed: Feb. 4, 2005

(86) PCT No.: PCT/JP2005/002100

§ 371 (c)(1),
(2), (4) Date: Aug. 15, 2006

(87) PCT Pub. No.: WO2005/078536

PCT Pub. Date: Aug. 25, 2005

(65) Prior Publication Data

US 2007/0164903 A1 Jul. 19, 2007

(30) Foreign Application Priority Data

Feb. 16, 2004 (JP) ..... 2004-037967

(51) Int. Cl.
*G04C 11/02* (2006.01)

(52) U.S. Cl. ..... 368/47; 368/46

(58) Field of Classification Search ..... 368/46, 368/47

See application file for complete search history.

(56) References Cited

U.S. PATENT DOCUMENTS

2001/0050694 A1 12/2001 Iwaki et al.
2003/0174584 A1 9/2003 Fujisawa et al.
2004/0202051 A1 10/2004 Ihara et al.
2005/0018543 A1* 1/2005 Fujisawa ..... 368/47

FOREIGN PATENT DOCUMENTS

| | | |
|---|---|---|
| CN | 1441330 A | 9/2003 |
| DE | 44 46 568 | 6/1996 |
| EP | 1 349 021 | 10/2003 |
| JP | 2002-168974 | 6/2002 |

(Continued)

*Primary Examiner*—Vit W Miska
*Assistant Examiner*—Jason Collins
(74) *Attorney, Agent, or Firm*—Greer, Burns & Crain, Ltd.

(57) ABSTRACT

A radio controlled time piece 1 actively using a time-programmed receiving operation and a forced receiving operation with respect to a standard radio signal and having an object the enablement of highly accurate and efficient time correction by properly receiving time information or calendar information and the like by executing a minimum amount of receiving operations, having a receiving means 2, a timekeeping means 18, a display means 4, a control means 10 for controlling the drive condition of the timekeeping means 18, an external input means 7, and a control information storage means 8, wherein when performing singularly or consecutively a time-programmed receiving operation that operates when a prescribed timekeeping value of the timekeeping means is reached, based on a first receiving method and a forced reception operation which operates by the operation of the external input means 7, based on a second receiving operation method, the first receiving method of time-programmed receiving operation and the second receiving method of forced receiving operation being established so as to be mutually different.

14 Claims, 15 Drawing Sheets

FOREIGN PATENT DOCUMENTS

| | | |
|---|---|---|
| JP | 2002-296374 | 10/2002 |
| JP | 2003-75561 | 3/2003 |
| JP | 2003-270370 | 9/2003 |
| JP | 2003-279676 | 10/2003 |
| JP | 2003-279678 | 10/2003 |
| JP | 3454269 | 10/2003 |
| JP | 2003-322687 | 11/2003 |

* cited by examiner

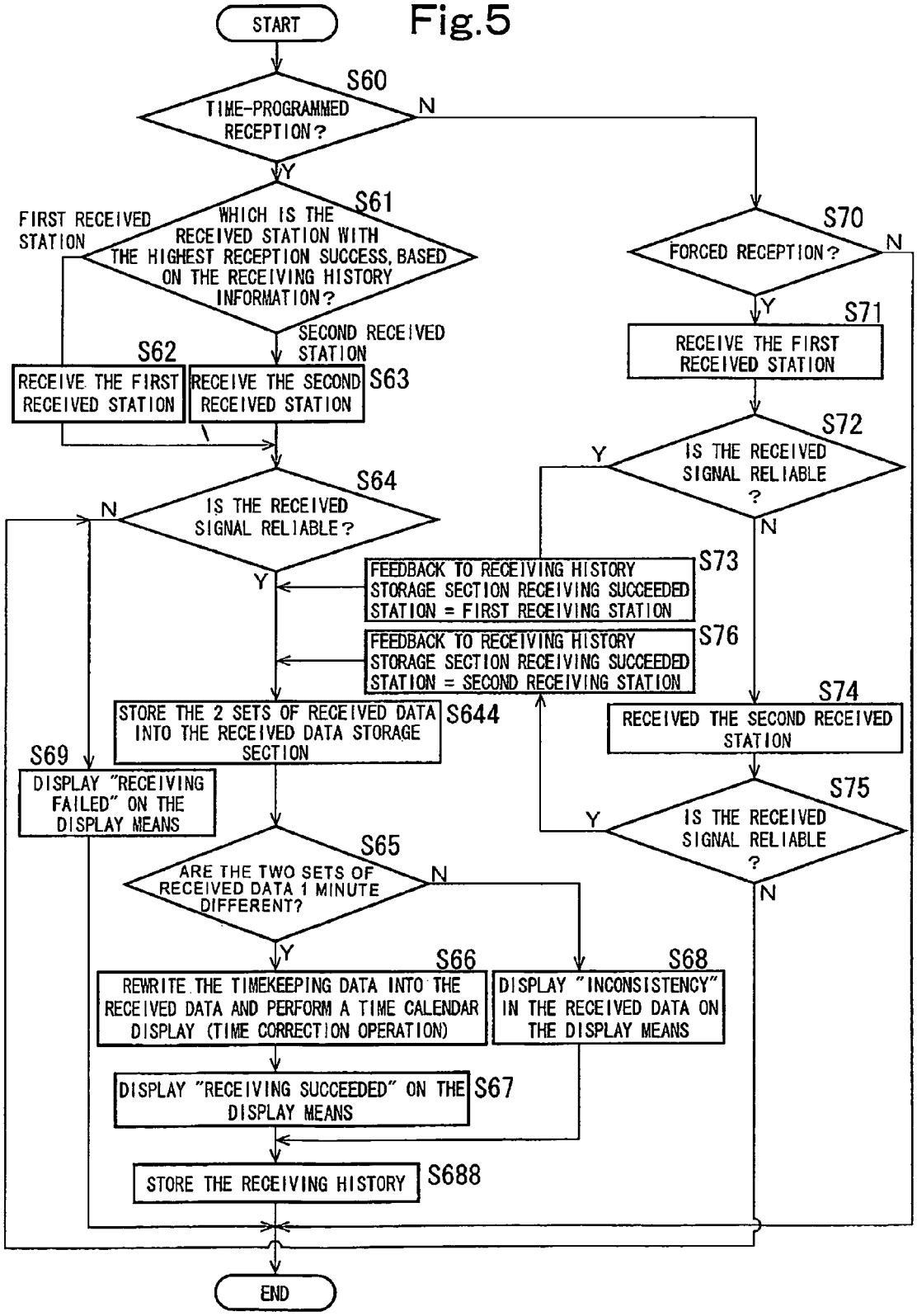
Fig.5
START
S60
TIME-PROGRAMMED RECEPTION?
N
Y
S61
WHICH IS THE RECEIVED STATION WITH THE HIGHEST RECEPTION SUCCESS, BASED ON THE RECEIVING HISTORY INFORMATION?
FIRST RECEIVED STATION
SECOND RECEIVED STATION
S62
RECEIVE THE FIRST RECEIVED STATION
RECEIVE THE SECOND RECEIVED STATION
S63
S64
IS THE RECEIVED SIGNAL RELIABLE?
N
Y
FEEDBACK TO RECEIVING HISTORY STORAGE SECTION RECEIVING SUCCEEDED STATION = FIRST RECEIVING STATION
S73
FEEDBACK TO RECEIVING HISTORY STORAGE SECTION RECEIVING SUCCEEDED STATION = SECOND RECEIVING STATION
S76
STORE THE 2 SETS OF RECEIVED DATA INTO THE RECEIVED DATA STORAGE SECTION
S644
S69
DISPLAY "RECEIVING FAILED" ON THE DISPLAY MEANS
S65
ARE THE TWO SETS OF RECEIVED DATA 1 MINUTE DIFFERENT?
N
Y
S66
REWRITE THE TIMEKEEPING DATA INTO THE RECEIVED DATA AND PERFORM A TIME CALENDAR DISPLAY (TIME CORRECTION OPERATION)
S68
DISPLAY "INCONSISTENCY" IN THE RECEIVED DATA ON THE DISPLAY MEANS
DISPLAY "RECEIVING SUCCEEDED" ON THE DISPLAY MEANS
S67
STORE THE RECEIVING HISTORY
S688
END
S70
FORCED RECEPTION?
N
Y
S71
RECEIVE THE FIRST RECEIVED STATION
S72
IS THE RECEIVED SIGNAL RELIABLE ?
Y
N
S74
RECEIVED THE SECOND RECEIVED STATION
S75
IS THE RECEIVED SIGNAL RELIABLE ?
Y
N

Fig.10

| | OPERATION | PERFORMANCE |
|---|---|---|
| FIRST FORCED RECEPTION MODE | PRESS FIRST BUTTON | RECEIVE FIRST RECEIVED STATION 2 TIMES |
| SECOND FORCED RECEPTION MODE | PRESS SECOND BUTTON | RECEIVE SECOND RECEIVED STATION 3 TIMES |

Fig.11

| | OPERATION | PERFORMANCE |
|---|---|---|
| FIRST FORCED RECEPTION MODE | PRESS FIRST BUTTON | RECEIVE FIRST RECEIVED STATION |
| SECOND FORCED RECEPTION MODE | PRESS SECOND BUTTON | RECEIVE SECOND RECEIVED STATION |

Fig.12

| | OPERATION | PERFORMANCE |
|---|---|---|
| FIRST FORCED RECEPTION MODE | PRESS FIRST BUTTON MOMENTARILY | RECEIVE FIRST RECEIVED STATION |
| SECOND FORCED RECEPTION MODE | PRESS FIRST BUTTON FOR A LONG TIME | RECEIVE THE FIRST RECEIVED STATION AND THEN THE SECOND RECEIVED STATION |

Fig.16

RECEIVING HISTORY INFORMATION TABLE

| ADDRESS | RECEIVED TRANSMITTING STATION | RECEIVING PROCESSING TIME | RECEIVED LEVEL |
|---|---|---|---|
| 1 | JJY FUKUSHIMA STATION | 3 MINUTES | H |
| 2 | JJY KYUSHU STATION | 6 MINUTES | H |
| 3 | JJY KYUSHU STATION | 5 MINUTES | M |
| 4 | RECEIVING ERROR | — — | — — |
| 5 | DCF77 | 8 MINUTES | L |
| 6 | DCF77 | 7 MINUTES | M |
| 7 | WWVB | 5 MINUTES | M |
| 8 | JJY FUKUSHIMA STATION | 2 MINUTES | H |
| 9 | JJY FUKUSHIMA STATION | 5 MINUTES | H |
| 10 | JJY KYUSHU STATION | 4 MINUTES | M |
| 11 | WWVB | 10 MINUTES | L |
| 12 | JJY FUKUSHIMA STATION | 6 MINUTES | M |
| · | · | · | · |
| · | · | · | · |
| N | · | · | · |

Fig.18

(a) HISTOGRAM RECEIVED INFORMATION TABLE

| ADDRESS | TRANSMITTING STATION | NUMBER OF SUCCESSFUL RECEPTIONS | ACCUMULATED RECEIVING PROCESSING TIME | AVERAGE RECEIVING TIME | AVERAGE RECEPTION LEVEL |
|---|---|---|---|---|---|
| 100 | JJY FUKUSHIMA STATION | 10 | 45 MINUTES | 4.5 MINUTES | H |
| 101 | JJY KYUSHU STATION | 7 | 31.5 MINUTES | 4.5 MINUTES | M |
| 102 | WWVB | 5 | 30 MINUTES | 6.0 MINUTES | M |
| 103 | DCF77 | 5 | 35 MINUTES | 7.0 MINUTES | M |

(b) HISTOGRAM RECEIVED INFORMATION TABLE

| ADDRESS | TRANSMITTING STATION | NUMBER OF SUCCESSFUL RECEPTIONS | ACCUMULATED RECEIVING PROCESSING TIME | AVERAGE RECEIVING TIME | AVERAGE RECEPTION LEVEL |
|---|---|---|---|---|---|
| 100 | JJY FUKUSHIMA STATION | 10 | 45 MINUTES | 4.5 MINUTES | H |
| 101 | JJY KYUSHU STATION | 7 | 35 MINUTES | 5.0 MINUTES | M |
| 102 | WWVB | 5 | 30 MINUTES | 6.0 MINUTES | M |
| 103 | DCF77 | 4 | 24 MINUTES | 6.0 MINUTES | L |

RADIO CONTROLLED TIME PIECE AND METHOD OF CONTROLLING SAME

BACKGROUND OF THE INVENTION

1. Field of the Invention

The present invention relates to a radio controlled time piece and a method for controlling same, and more particularly to a radio controlled time piece and control method which limits electrical power consumption, and also maintains the precise time information at all times.

2. Background Art

A time piece configured to receive a radio wave signal including time information and automatically correct the time to the precise time has already been practically developed. Additionally, radio wave signals (hereinafter referred to as standard radio wave signals) which include standard time information for use in a radio wave signal controlled watch are transmitted, for example, in a number of countries, such as Japan, US, Germany, UK, and China and the like.

The frequency and transmitted data format of the above noted radio wave signals, which include time information, differ.

A radio controlled time piece, such as noted above, in general can be classified as a time piece of the type in which forced reception operation is performed by a user, or a time piece of the type that performs a time-programmed operation. In a forced reception operation, the user, as necessary, operates a prescribed external input means, such as a switch, a button, a stem or the like, so as to forcibly receive a standard radio wave signal that includes the above-noted time information. A time piece of the type that performs the time-programmed operation uses a set program of conditions that is pre-determined, based on the timekeeping information value of a timekeeping means reaching a prescribed value, whereby automatic time correction is performed by receiving the prescribed standard radio wave signal at a prescribed receiving time. There are radio controlled time pieces which use each of these receiving methods individually, and radio controlled time pieces which make use of both of the above-noted receiving methods. In a radio controlled time piece of this type, where the user of the radio controlled time piece moves from a prescribed area (or country) to another area (or country), or even within one and the same prescribed area (or country), and the user of the time piece is in a location (for example, behind a building or in an underground room) where it is not possible for the standard radio to reach the watch, neither of the above-noted receiving operation methods will enable reception of the standard radio wave signal that includes the prescribed information. In this type of case, where, as noted above, both of the receiving methods are provided together, and in the case in which the time-programmed receiving method only is provided, the operation of time-programmed reception operation is performed repeatedly using the time-programmed receiving operation method. In the case in which both receiving operation methods are provided, when the user executes a forced-reception operation, operation occurs using, of course, this forced reception method. However, in the case of time-programmed reception method, because execution is always performed when a predetermined time has come, more attention is required.

However, the operation of receiving a standard radio wave signal that includes time information in a radio controlled time piece is one that consumes a considerable amount of electrical power, so that in such a time-programmed reception operation mode, execution of the receiving operations is made over a long period of time in accordance with the prescribed reception mode, regardless of the fact that reception is not possible. Unwanted power consumption occurs because the receiving operation is repeated. As a result, there is an increase in the overall power consumption, so that not only is the battery life shortened, but also there is a problem of an increase in cost for battery replacement. In a radio controlled time piece of the re-chargeable type, in the condition in which the charge is not so high, there is wasteful power consumption for the purpose of repeating the receiving operation, regardless of the fact that reception is not possible. As a result, there is an increase in the overall power consumed, thereby resulting in a problem not only with receiving operation, but also a problem of the time piece ultimately stopping.

In the case in which the user of a radio controlled time piece that includes time information moves to a region or country in which it is not possible to use the standard radio wave signal that had been received up to that point, or if the user is in the shadow of a building or in an underground room, the time piece is placed in a condition in which it is not possible at all to perform time correction using a time-programmed reception. But in the case in which the configuration of the radio controlled time piece is such that it can receive a standard radio wave signal, including time information utilizing the forced reception operation, even in the condition in which it is not possible to receive using time-programmed reception, when the user comes up to an outside area of a building from an underground room, by executing forced reception operation for a standard radio wave signal, it is possible to successfully receive the standard radio wave by performing the forced reception operation.

However, even if a radio controlled time piece is provided with forced reception operation mode, because the standard radio wave signal that includes time information is normally set to one type only, for example in the case of movement from a prescribed region (or country) to another region (or country), even if there is no problem for the case in which there is a receivable station that broadcasts a standard radio wave signal that can be received within that region or country, in a different case, because time correction is not possible, there is a loss of usability of the radio controlled time piece.

On the other hand in Japanese un-examined patent publication No. (KOKAI) 2003-270370, there is a time data receiving apparatus having a timekeeping means, a radio wave signal receiving means capable of receiving a plurality of radio wave signals which have different frequencies and include time data, a receiving frequency switching means for switching the frequency of radio wave signals that are received by the radio wave signal receiving means, a controlling means for controlling the switching of the frequency by the receiving frequency switching means, and a time correction means for correcting the current time data, based on the time data included in a radio wave signal that is received by the radio wave signal receiving means. This further has a success/failure judging means for judging the success or failure of reception of a radio wave signal by the radio wave signal receiving means, and a storage means for storing the frequency. Further, the above-noted control means performs control of the above-noted receiving frequency switching means so that the frequency of the radio wave signal received by the radio wave signal receiving means is switched to a frequency that is stored in the storage means. Also, in the case in which the success/failure judgment means makes a judgment of failure, the control means performs control so that the receiving frequency switching means is switched from the current frequency to another frequency. In the case in which the success/failure judging means returns a judgment of success, control is performed so that the frequency of a radio wave signal received by the radio wave signal receiving means is stored into the storage means.

In the Japanese un-examined patent publication No. (KOKAI) 2002-296374, there is a time information acquisition method, whereby a plurality of time information signals having differing frequencies are received and the receiving condition of each of the time information signals is detected. A specification is made of one time information signal for time information acquisition from the above-noted time information signals, based on these receiving conditions, and time information being acquired from that specified time information signal.

In addition, in Japanese un-examined patent publication No. (KOKAI) 2003-75561, there is an automatically corrected time piece that performs time correction by receiving a plurality of standard radio wave signals having differing frequencies and including a standard time signal and performing the correction based on these standard time signals. The time piece comprises a receiving section which can set a plurality of resonance frequencies in accordance with a control signal. The receiving section further enables the demodulation of the received standard radio wave received with the resonance frequency and thus sets an output standard time signal. Also included is a control circuit which outputs to the receiving section a control signal to set a resonance frequency being different from the above-mentioned set resonance frequency for the case when it is not possible for the receiving section to demodulate the standard time signal from the standard radio wave with a set resonance frequency within a predetermined limited period, and perform the time correction operation based upon the standard time signal.

In Japanese Patent No. 3454269, there is a radio controlled time piece indicated which has a timekeeping means, a current time display means for displaying the current time in accordance with timekeeping, a receiving means for receiving a radio wave signal that includes time information, a receiving power supply control means for causing periodic operation of a receiving power supply means that drives the receiving means, and a current time correction means for correcting the current time of the timekeeping means based on the time information received by the receiving means. Additionally, in this watch, the receiving power supply control means has an elapsed-time detection means for determining the amount of time elapsed from the time of the previous reception of the radio wave, a schedule information setting means for setting the schedule information that establishes the operating time interval when periodic operation of the receiving power supply means is to be performed, and a power supply means control means for controlling the operation of the receiving power supply means, based on the above-noted schedule information. The above-noted schedule information setting means is configured so as to switch the above-noted schedule information when the elapsed time reaches a set time or above, and to schedule information where the time interval for operation is longer than an initially set value.

DISCLOSURE OF THE INVENTION

However, in the above-described prior examples, although there is disclosure of a method of switching the reception of a plurality of standard radio wave signals with different frequencies or the like, this is merely a disclosure of a limited improved technology. In order to efficiently search for a specific standard radio wave signal including time information that is required and to improve the receiving success ratio, it is not possible to achieve a radio controlled time piece that is directed at a single standard radio wave signal or a plurality of standard radio wave signals. This can be overcome with a time piece that detects a standard radio wave signal that includes the required time information with good accuracy and in a short period of time through the combined use of time-programmed reception operation and forced reception operation, and further using a method of operation where either one of or both of the time-programmed operation and forced reception operation are selected in response to a situation while also suppressing power consumption.

Accordingly, it is an object of the present invention to solve the above-noted problems with the prior art, by having a simple configuration, and positively making use of a combination of a time-programmed reception operation and a forced reception operation. With this configuration, the standard radio wave signal is properly received with a minimal receiving operation. The time information and calendar information and the like from a standard radio wave signal should also be received with good quality. The above mentioned features provide a radio controlled time piece with high accuracy and the ability to correct the time.

In addition, in the present invention, it is an object to achieve a highly accurate radio controlled time piece that makes use of time-programmed reception operation and forced reception operation to receive a plurality of standard radio wave signals so as to reliably receive information such as time information and calendar information from a standard radio wave signal with good efficiency. It is an additional object to provide a radio controlled time piece wherein even in the case in which a user moves from a prescribed region (or country) in which it is possible to receive a first standard radio wave signal to a different region (or country) in which it is possible to receive a second standard radio wave signal, it is possible to detect a standard radio wave signal that includes the required time or calendar information with high efficiency and in a short period of time, while suppressing the consumption of electrical power so as to minimize the electrical power.

In order to achieve the above-noted object, the present invention adopts the following basic technical constitution.

Specifically, a first aspect of the present invention is a radio controlled time piece which receives a standard radio wave signal including a standard time information signal and performs time correction based on the standard time information signal, this radio controlled time piece minimally having a receiving means, a timekeeping means for keeping time or calendar information, a display means, a control means for controlling the drive condition of the timekeeping means, an external input means, and a control information storage means based on the first receiving method. When performing singularly or consecutively a time-programmed receiving operation that operates when a prescribed timekeeping value of the timekeeping means is reached at a predetermined time. Also included is a forced reception operation which operates by the operation of the external input means, based on a second receiving operation method. The first receiving method of the time-programmed receiving operation and the second receiving method of the forced receiving operation are established so as to be mutually differing. A second aspect of the present invention is a radio controlled time piece configured similarly to the first aspect, wherein it is possible to receive a plurality of standard radio wave signals.

A third aspect of the present invention is a time correction method in a radio controlled time piece configured so as to perform time correction based on receiving a standard radio wave signal including a standard time information signal and the standard time information thereof. This method has a first receiving method step of performing a time-programmed receiving operation based on a first receiving method. A second receiving method step of performing forced receiving operation is based on a second receiving method, wherein, when singularly or consecutively performing the first receiving method step and the second receiving method step, the first receiving method step and second receiving method step mutually differ. Additionally, a fourth aspect of the present invention is a time correction method of the third aspect, wherein it is possible to receive a plurality of types of standard radio wave signals.

Another aspect of a radio controlled time piece according to the present invention is one that is configured such that the condition of setting the first receiving method and the second receiving method, so as to be mutually different, is such that the frequency of success of receiving the standard radio wave signal is mutually different.

In another aspect of a radio controlled time piece according to the present invention, the condition in which the setting is made so that the first receiving method and the second receiving method are mutually different is configured so that the reception success rates of receiving the standard radio wave signal is mutually different.

In a different aspect of a radio controlled time piece according to the present invention, the condition of the reception success rates of receiving the standard radio wave signal being different is configured so as to cause the number of trial drives of the receiving means receiving the standard radio wave signal to differ from each other.

In a different aspect of a radio controlled time piece according to the present invention, pluralities of differing time-programmed receiving operation modes are provided.

In a different aspect of a radio controlled time piece according to the present invention, in the time-programmed receiving operation, the second time-programmed receiving operation mode is executed so as to perform time-programmed reception only in the case in which it is not possible to receive the standard radio wave signal using the first time-programmed receiving operation mode.

In a different aspect of a radio controlled time piece according to the present invention, the first time-programmed receiving operation mode and the second time-programmed receiving operation mode mutually differ at least partially in terms of the time at which the time-programmed receiving operation is executed.

In a different aspect of a radio controlled time piece according to the present invention, in the forced reception operation, a plurality of mutually different forced reception operation modes are provided.

In a different aspect of a radio controlled time piece according to the present invention, in the case in which there is a history of success in receiving operation using the time-programmed operation within a prescribed period of time in the time-programmed receiving operation mode, in the next time-programmed receiving operation mode, reception operation is not done without causing operation of the receiving means.

In a different aspect of a radio controlled time piece according to the present invention, the plurality of types of standard radio wave signals can be received by the receiving means even if the receiving station or frequencies differ.

In a different aspect of a radio controlled time piece according to the present invention, there is an nth time-programmed receiving operation mode and a (n+1)th time-programmed receiving operation mode provided, wherein these time-programmed receiving operation modes have mutually differing standard radio wave signals that they receive.

In a different aspect of a radio controlled time piece according to the present invention, there is provided an nth time-programmed receiving operation mode and an (n+1)th time-programmed receiving operation mode, wherein the (n+1)th time-programmed receiving operation mode is only executed to perform a receiving operation in the case in which the nth time-programmed receiving operation mode could not receive a prescribed standard radio wave signal.

In a different aspect of a radio controlled time piece according to the present invention, the configuration is such that in the nth time-programmed receiving operation mode the radio wave signal from the nth receiving station is received and the radio wave signal is received from the (n+1)th receiving station in the (n+1)th time-programmed receiving operation mode.

In a different aspect of a radio controlled time piece according to the present invention, the configuration is such that a signal having a nth frequency is received in the nth time-programmed receiving operation mode and a radio wave signal having a (n+1)th frequency is received in the (n+1)th time-programmed receiving operation mode.

In a different aspect of a radio controlled time piece according to the present invention, the configuration is such that in the forced receiving operation, selection is made of one receiving station from among a plurality of receiving stations.

In a different aspect of a radio controlled time piece according to the present invention, when an operation is performed to select one station among a plurality of receiving stations, a receiving station is selected by either an operation of a mutually different operation means or by a mutually different operation means in one and the same operation means.

In a different aspect of a radio controlled time piece according to the present invention, a receiving station that is selected by a forced receiving operation is used as the receiving station to be received at the very first among a plurality of receiving stations in a time-programmed receiving operation.

In a different aspect of a radio controlled time piece according to the present invention, based on receiving history information over a prescribed period of time for reception of a plurality of standard radio wave signals from a plurality of types of receiving stations, a receiving station that is judged to have the highest receiving success rate within the receiving history information is selected as the receiving station which receiving the radio wave signal for the very first time in the time-programmed receiving operation thereafter.

In a different aspect of a radio controlled time piece according to the present invention, based on the receiving history information for a prescribed period of time for receiving standard radio wave signals having a plurality of types of frequencies, the frequency of the standard radio wave signal that is judged to have the highest receiving success rate within the receiving history information is used as the frequency for the first reception using time-programmed receiving operation thereafter.

In a different aspect of a radio controlled time piece according to the present invention, in the time-programmed receiving operation, the configuration is such that the first time-programmed receiving operating mode and the second time-programmed receiving operation mode are always executed.

In a different aspect of a radio controlled time piece according to the present invention, only one of the first time-programmed receiving operation mode and second time-programmed receiving operation mode is repeated.

In a different aspect of a radio controlled time piece according to the present invention, a radio controlled time piece that is capable of receiving a plurality of types of standard radio wave signals performs reception of a plurality of types of standard radio wave signals using the forced reception operation and receives one prescribed standard radio wave signal among of the plurality of standard radio wave signal types using the time-programmed receiving operation.

In a different aspect of a radio controlled time piece according to the present invention, one prescribed standard radio wave signal among of a plurality of standard radio wave signals of a time-programmed receiving operation is established as a standard radio wave signal for which the previous reception succeeded among a plurality of the standard radio wave signals received by forced reception operation.

In a different aspect of a radio controlled time piece according to the present invention, based on receiving history information over a prescribed period of time for a plurality of types of standard radio wave signals, one prescribed standard radio wave signal of the plurality of standard radio wave signals is selected as the standard radio wave signal that is judged to have the highest receiving success rate within the receiving history information by the time-programmed receiving operation.

An aspect of a time correction method in a radio controlled time piece according to the present invention is configured so that in a forced receiving operation in the second receiving method step, one receiving station among a plurality of types of receiving stations is selected as the receiving station.

BRIEF DESCRIPTION OF THE DRAWINGS

FIG. 5 is a flow chart showing an example of the operating procedure in another specific example of a radio controlled time piece according to the present invention.

FIG. 10 is a drawing showing an example of the setting operation in the forced receiving operation mode in a specific example of a radio controlled time piece according to the present invention.

FIG. 11 is a drawing showing another example of the setting operation in the forced receiving operating mode in a specific example of a radio controlled time piece according to the present invention.

FIG. 12 is a drawing showing a different example of the setting operation in the forced receiving operating mode in a specific example of a radio controlled time piece according to the present invention.

FIG. 16 is a drawing showing an example of the receiving history information table for transmitting stations received that is stored in the memory circuit 22 of a radio controlled time piece according to the present invention.

FIG. 18 is a graph showing the histogram receiving information in a radio controlled time piece according to the present invention.

FIG. 18(*a*) is the histogram receiving information that describes a first example of a receiving operation, and FIG. 18(*b*) is the histogram receiving information explaining the second specific example of a receiving operation.

BEST MODE FOR PRACTICING THE PRESENT INVENTION

An embodiment of a radio controlled time piece and a time correction method in a radio controlled time piece according to the present invention is described in detail below with references made to drawings.

Embodiments

Figure 1:
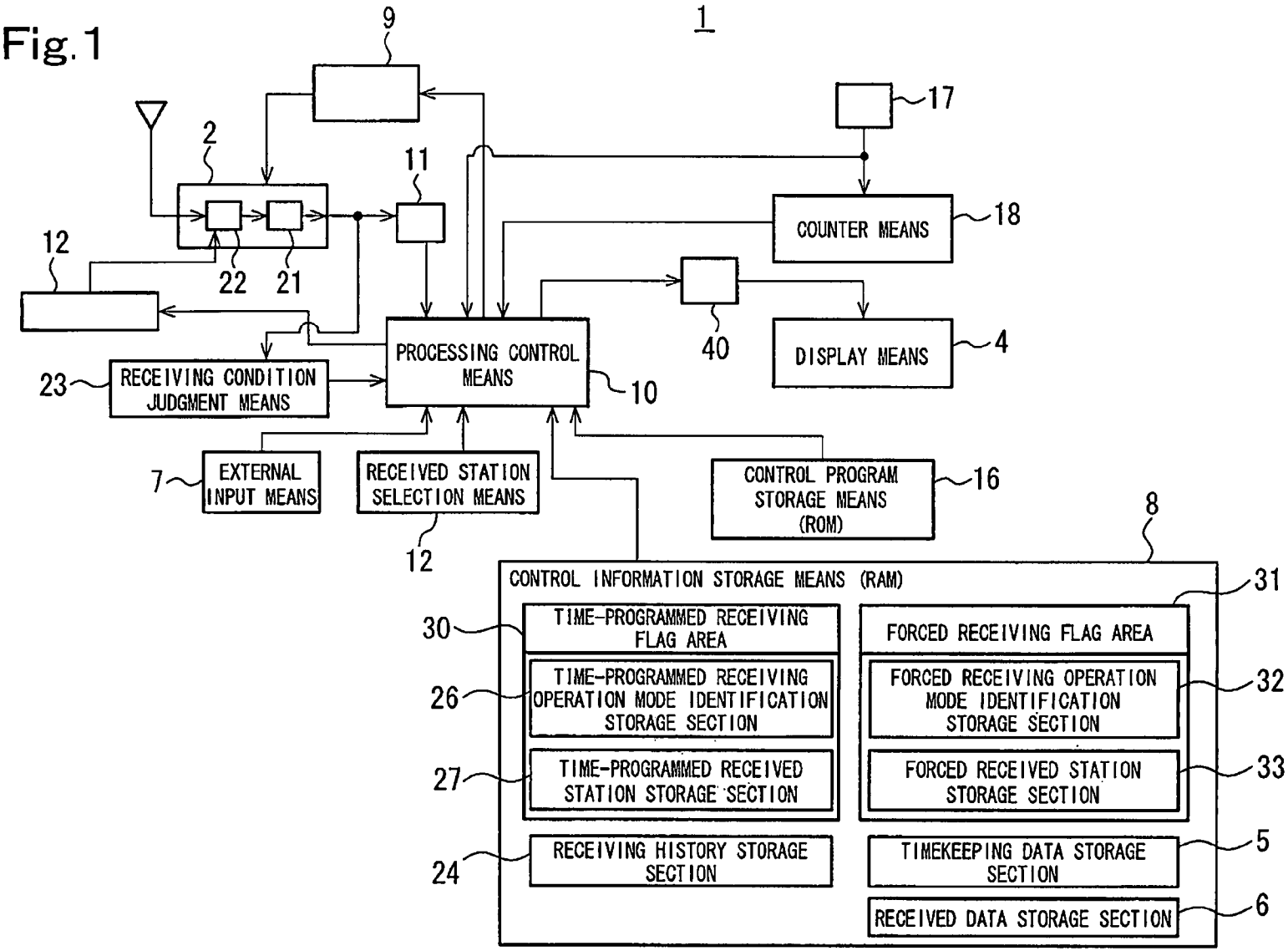
FIG. 1 is a block diagram showing a specific example of a configuration of a radio controlled time piece according to the present invention.

Specifically, FIG. 1 is a block diagram showing the configuration of a specific embodiment of a radio controlled time piece 1 according to the present invention. In this drawing, what is shown is a radio controlled time piece 1 configured so as to receive a standard radio wave signal including a standard time information signal and, based on the standard time information signal, to correct the time. This radio controlled time piece 1 has at minimum a receiving means 2, a timekeeping data storage section 5 that is a timekeeping means that keeps time of time information or calendar information, a display means 4, a calculation control means 10 that is configured by a CPU or the like that controls a drive condition of the timekeeping data storage section 5, an external input means 7, and a control information storage means 8. A time-programmed receiving operation is performed when the timekeeping data storage section 5 reaches a prescribed timekeeping information value, based on a first receiving method and a forced receiving operation performed by operation of the external input device, based on a second receiving method, are performed either individually or sequentially. The first receiving method in the time-programmed receiving operation and the second receiving method in the forced receiving operation are set as to be mutually different.

In addition, in the radio controlled time piece 1 according to the present invention, as shown in FIG. 1, various means are provided as appropriate. These include a receive means driving means 9, a processing control means 10 that controls the drive condition of the timekeeping data storage section 5 and performs individual processing control of a plurality of means to be described later, a code judgment means 11 that extracts prescribed information from a standard radio wave signal that is received and includes time information, a received station selection means 12 for the purpose of receiving a standard radio wave signal, a control program storage means 16 which stores various control programs and which is generally configured as a ROM, and a reference signal generating means 17. Additionally, a receiving means 2 that is formed by a received station switching circuit 22 is included in this configuration. The received station switching circuit 22 inputs a signal that selectively controls the received station from the received station selecting means 12 via the received station selecting control signal output means 12' and a receiving circuit 21. A display drive means 40 that displays the time correction results and drives the display means 4 is also included.

Additionally, it is possible to provide such means as a receiving condition judgment means 23 that inputs the output from the receiving means 2 and outputs the result of a judgment with regard to the receiving condition to the calculation control means 10, and a receiving history storage means 24 and the like.

Also, in the embodiment shown in FIG. 1, the counter means 18 generates a halt/release signal for the purpose of halting and releasing the calculation control means 10 performing at a predetermined frequency, for example, at 1 Hz in this embodiment, generated via an appropriate frequency-division means or the like from a reference signal of a prescribed frequency that is generated from the reference signal generation means 17. This halt/release signal is outputted to the calculation control means 10. The processing that occurs when the calculation control means 10 receives that signal is that the halt condition of the CPU is released and a second data of the time calendar data of the timekeeping data storage means 5 that counts the time calendar data in the control information storage means 8 is incremented by 1 second. If necessary, carrying processing is also performed with the minute data, hour data, day data, and the like so as to count the time (calendar) data by a carrying operation. The prescribed time information or the calendar information in the timekeeping data storage section 5 is displayed on the display means 4 after updating each second.

In this specific embodiment of the present invention, the example shown is one in which various control programs that are stored in the control program storage means 16 that is formed by a ROM are used to perform prescribed processing of data in the control information storage means 8 that stores control information of various types. This processing of data is performed by the calculation control means 10. The present invention is not, however, limited to this specific example, and it is further possible to configure this using random logic, without using CPU.

In this embodiment, an example that is presented in the case of correcting the time based on a received standard radio wave signal is one in which, based on control of the calculation control means 10 by a program in the control program storage means 16, operations are performed on prescribed data in the control information storage means 8 so as to perform software processing that makes the time correction. For example, it is possible to configure the timekeeping data storage section 5, which is the timekeeping means in the present invention, not as RAM, but rather, for example, as a timekeeping means that is a counter means formed by the combination of flip-flops and gates.

The receiving operation is described as follows. A received signal that is received and captured is subject to a judgment as to whether or not the received signal is reliable, In the case in which the judgment is "reliable," the received signal data is stored in the received data storage section 6.

Also, as another part of the processing, after storage into the received storage data section 6, judgment processing is performed to determine whether or not the received data stored in the received data storage section 6 is reliable. In the case in which the judgment is "no reliability" for the received signal in the receiving condition judgment means 23, which is described later, rather than performing the switching processing of this data in the received data storage section 6 to the time keeping data storage 5 only in the case in which the judgment is "reliable," the data of the timekeeping data storage section 5 is replaced in the data of the received data storage section 6, and the time (calendar) correction can be performed. In this case, it is possible to omit the control of "capture two sets of received data, and judge whether or not the two time calendar data are 1 minute different," as described later.

Also, the receiving condition judgment means 23 in FIG. 1 is a means that performs a judgment with regard to "reliable" of the received signal, and a rectangular pulse that includes a long-wave standard radio wave signal (rectangular pulses defined in terms of width of "0", "1", and "p") is input from the receiving means 2.

Additionally, at the receiving condition judgment means 23, the rising edge of the signal from the receiving means 2 is additionally detected and the detected interval is counted. This count value is used to make a judgment with regard to the received signal of "reliable" or "unreliable." Specifically, while this count value should normally be an interval of 1-second, depending upon the reception environment (intensity or existence and nonexistence of noise, and the like), if the 1-second period is unstable, the received signal is "unreliable" in that case and there will be disturbance.

A comparison is made of this count value with a prescribed comparison value (for example, 1 second ±32 ms) of about 10 seconds. By making a judgment of "reliability" with regard to the received signal, a judgment is made with regard to the receiving condition. The method of performing this receiving condition judgment can also be a different method and is not limited to the method disclosed herein. For example, it is alternatively possible to make a judgment of "reliability" for the received signal, that is the standard radio wave signal including time information in the receiving condition judgment means 23, by detecting the electric field strength.

If, in this operation it is possible to make the judgment of "reliable" for the received signal, processing is performed to store the received data that is captured into the received data storage section 6 based on a prescribed algorithm that is stored in the control program storage means 16 in the calculation control means 10.

Next, the processing after storage of the received data into the received data storage section 6 is described below.

The timekeeping data storage section 5 in the present invention is a storage means for storing timekeeping data that is corrected by a received standard radio wave signal.

The rectangular pulse (in which the "0", "1", and "P" codes are defined as rectangular pulse widths) included in the standard long-waive radio wave signal is formed as a one-minute set wherein one set of received data includes data such as time and calendar data. Given this, from a different standpoint from the reliability of the received signal which is the judgment of the receiving condition in the receiving condition judgment means 23, after the judgment of "reliable" for the received signal, for the purpose of verifying the reliability of the received data, an operation of "capturing two sets of received data and making a judgment as to whether or not the two time and calendar data differ by one minute" is performed by the calculation control means 10 based on a prescribed algorithm stored in the control program storage means 16 (refer to FIG. 2, which is described later). In addition, in this case the received data storage section 6 is a memory having a capacity that enables the storage of two sets of received data. As an explanation of the idea behind verifying the reliability of received data, although it only happens rarely, in the case in which a mistransmission is made of a radio wave signal from a transmitting station that transmits a standard long-wave radio wave signal, it is effective to judge the reliability of the received data. In the case in which after the judgment is made, a judgment is "reliable," based on a prescribed algorithm stored in the control program storage means 16, processing is performed to replace the data in the timekeeping data storage means 5 with the data in the received storage data means 6 in the processing control means 10, and this time and calendar data is used to correct the time (calendar).

On the other hand, in the case in which the received data is judged to be "unreliable," a prescribed algorithm for the purpose of displaying "inconsistency in received data" is stored in the control program storage means 16, so as to provide alarm information to a user in the event of reception that has not yet occurred.

As described above, whereas the timekeeping data storage means 5 in the present invention is a storage means for storing timekeeping data that is corrected by a received standard radio wave signal, when a standard radio wave signal is received, the receiving history storage section 24 is a storage means that stores data with regard to all standard radio wave signals that are received, for example, receiving station, receiving frequency, received time, receiving condition (electric field strength), and whether or not reception succeeded.

In the present invention, in the specific example of FIG. 1, in addition to the above-described configuration, the control information storage means 8 that is configured as, for example, a RAM and that is connected to the above-noted calculation control means 10, is possibly provided with a time-programmed receiving flag region 30 that includes a time-programmed receiving operation mode identification storage means 26 and a time-programmed receiving station storage section 27, and a forced receiving flag area 31 that includes a forced receiving operation mode identification storage section and a forced receiving station storage section 33. The control information storage means 8, as described earlier, includes the above-described timekeeping data storage section 5 and received data storage section 6.

Essentially, in the present invention, in contrast to the receiving method for a standard radio wave signal that includes time information in a radio controlled time piece of the past, in response to either a receiving history or a condition, an arbitrary selection is made between the time-programmed receiving operation and the forced receiving operation so that it is possible to perform time correction operation. Accordingly, when a user uses the radio controlled time piece, there is freedom to enable the main time-programmed receiving operation in which a receiving operation is performed automatically and a "sub" receiving operation which is a forced receiving operation that is performed by the operation of, for example, an external input means 7 in the case in which a standard radio wave including a prescribed time information could not be received under the time programmed receiving operation.

Of course, in the present invention it will be understood that it can be envisioned that the method of using the radio controlled time piece is one in which the manual forced receiving operation is performed as the main receiving operation.

In the radio controlled time piece 1 of the present invention, it is necessary to make a setting so that the first receiving method, in the case in which the time-programmed receiving operation is performed, and the second receiving method, in the case in which the forced receiving operation is performed, are mutually different and a specific method of establishing the first receiving method for the case of the time-programmed receiving operation, and second receiving method in the case of the forced receiving operation are different is, for example, when establishing a mutual difference between the degrees of receiving success in receiving the standard radio wave signal.

Specifically, the condition in which there is mutual difference between the degree of receiving success in receiving a standard radio wave signal is, for example, an arrangement in which the number of trial drives of the above-noted receiving means 2 for the purpose of receiving the standard radio wave signal is mutually different. More specifically, for example, it is possible to adopt a configuration in which the number of trial drives in the first receiving method for the case of executing a time-programmed receiving operation is set to three times, and the number of trial drives in the second receiving method in the case in which forced receiving operation is performed is set to one time. In reverse, it is also possible to envision a configuration in which the number of trial drives in the first receiving method in the case in which time-programmed receiving operation is set to one time and the number of trial drives in the second receiving method in the case of executing forced receiving operation is set to three times.

In a specific example of the present invention, in the case in which time correction is performed by receiving a standard radio wave signal that includes time information, in accordance with a prescribed processing program stored in the control program storage means 16, for example, when a time-programmed receiving operation flag area 30 is selected, prescribed software selects the time-programmed receiving operation mode. Next, the time-programmed method setting signal is output from the calculation control means 10, and a program stored in the control program storage means 16 selects a prescribed receiving station from information with regard to the receiving stations transmitting standard radio wave signals including one or a plurality of time information. This information is outputted via the receiving station selection control signal output means 12. If necessary, a prescribed receiving operation mode is selected from a plurality of types of time-programmed receiving operation modes used in the time-programmed receiving operations stored in the time-programmed receiving mode identification storage section 26. This includes a time-programmed receiving flag region 30 (first time-programmed receiving operation mode, second time-programmed receiving mode, third time-programmed receiving operation mode, . . . ) and the receiving operation mode is selected in accordance with a prescribed processing program stored in the control program storage means 16. The receiving means 2 is then caused to operate.

The various instruction information is passed to the receiving means 2, and the set time-programmed receiving operation is started.

The selection of various prescribed information in the present invention is executed entirely in accordance with a prescribed program.

Also, in this specific example, it is possible to execute the operation of each of the means by random logic, without using software in the control program storage means 16.

Additionally, in this specific example of the present invention, in the case of performing time correction by receiving a standard radio wave that includes time information, in accordance with a prescribed processing program stored in the control program storage means 16, for example, when the forced receiving operation flag region 31 is selected, the forced receiving operation mode is selected by prescribed software. Next, a forced receiving method setting signal is output from the calculation control means 10. A prescribed receiving station is then selected from information about receiving stations that transmit a standard radio wave signal that includes one or a plurality of time information. That information is outputted as that signal via the receiving station selection control signal output means 12', or, if necessary, a desired receiving operation mode is selected from a plurality of forced receiving operation modes used in forced receiving operation stored in the forced receiving operation mode identification storage section 32 which is included in the forced receiving operation flag area 31 (first time-programmed receiving operation mode, second time-programmed receiving mode, third time-programmed receiving operation mode, . . . ). The receiving operation mode is then selected and the receiving means 2 is caused to operate in accordance with a prescribed processing program stored in the control program storage means 16.

The various instruction information is passed to the receiving means 2 and the set forced receiving operation is started.

The selection of the various prescribed information noted above is executed completely in accordance with a prescribed program.

In this specific example, it is also possible to execute the operations of the various means in the form of random logic without using software in the control program storage means 16.

The receiving means 2 receives a standard radio wave signal from a transmitting station that transmits a standard radio wave signal that includes time information at a specified frequency. And, for example, when "reliable" and for the received signal is verified by the received condition judgment means 23 and, simultaneously, "reliable" for the received data is verified by "capturing two sets of received data and judging whether or not the difference between the time and calendar data is one minute" in the calculation control means 10 based upon a predetermined algorithm stored in the control program storage means 16, the "received signal is judged to be normal." In this case, the data of the above-noted timekeeping data storage section 5 is overwritten by the data in the received data storage section 6 so as to correct the time (calendar), the current exact time (calendar) information being displayed on the display means 4, and "receiving succeeded" being displayed as well on the display means 4.

Then, simultaneously, the history of the above-noted receiving operation is stored into the receiving history storage section 24 that is provided for each receiving station.

In the present invention, detecting the electric field strength can also make the judgment as to whether or not a standard radio wave signal including time information was received normally.

Figure 2:
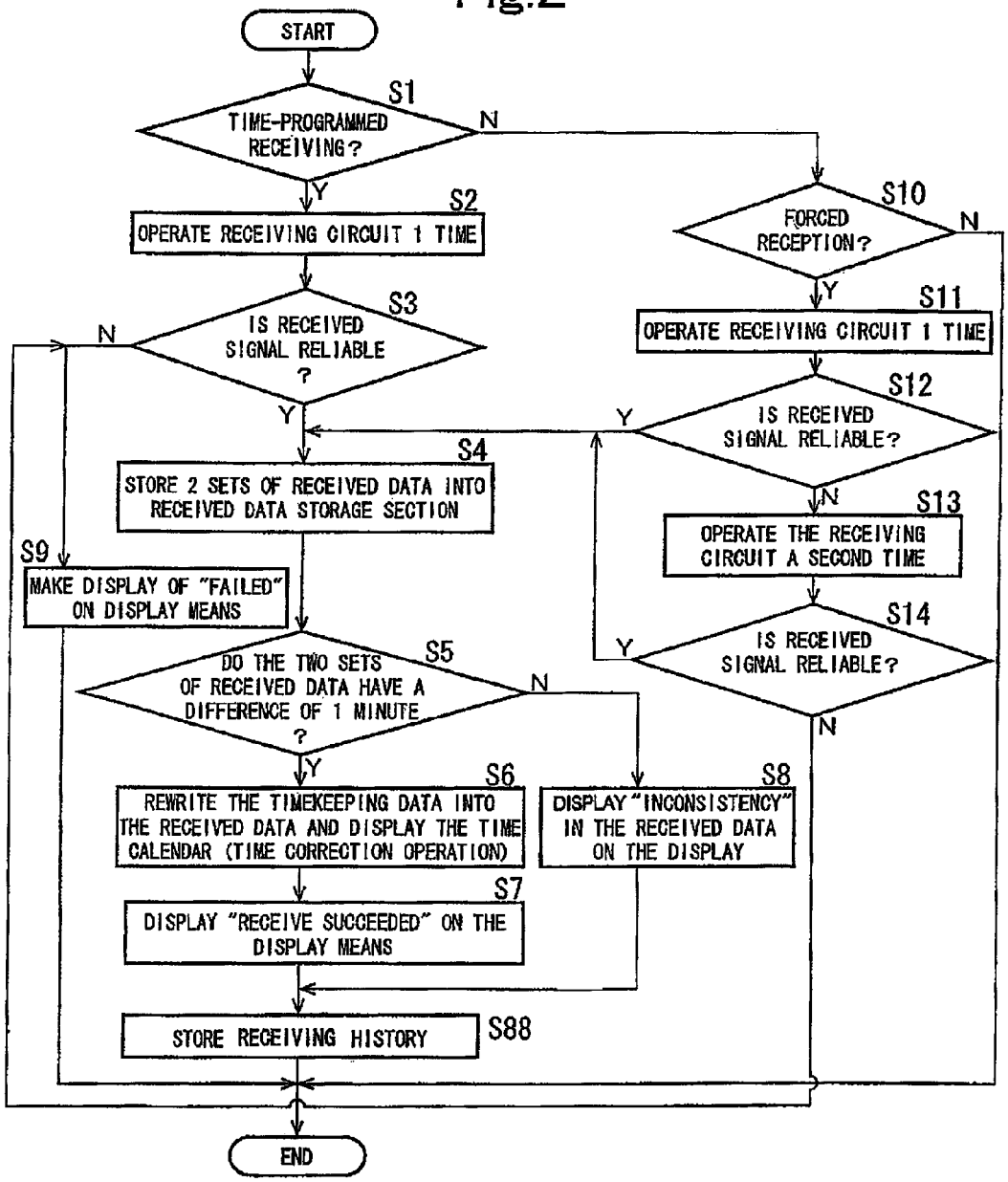
FIG. 2 is a flow chart showing an example of the operating procedure in a specific example of a radio controlled time piece according to the present invention.

An example of the operating procedure in the specific example of the present invention as described above will now be described with reference made to FIG. 2.

Specifically, in this specific example, in performing one receiving operation using the time-programmed receiving operation, the receiving circuit 21 is operated one time. In performing the receiving operation one time of the forced receiving operation, the operation of the receiving circuit 21 is repeated twice. The condition in which the setting is made so that the first receiving method of time-programmed receiving and the second receiving method of forced receiving operation are mutually different is made by causing the number of trial drives of the receiving means for receiving the standard radio wave signal to differ from each other so that each one of the reception success rates for receiving the standard radio wave received by both methods are different from each other. After starting, at step S1, a judgment is made as to whether or not the operation is a time-programmed receiving operation and, in the case of YES, processing proceeds to step S2 where a time-programmed receiving operation is executed. Then, at step S3, a judgment is made, by the receiving condition judgment means 23, as to whether the received signal is reliable and, in the case of "reliable," in which the result is YES, processing proceeds to step S4, and the above-noted two sets of received data are stored into the received data storage section 6.

Then processing proceeds to step S5 and, for the purpose of verifying the reliability of the received data, at step S5 "two sets of received data are captured and a judgment is made as to whether or not the two time and calendar data differ by one minute," is executed and in the case of "reliable," in which the result is YES, processing proceeds to step S6, at which the data in the above-noted timekeeping data storage section 5 is overwritten by the data in the received data storage section 6 so as to correct the time (calendar) and display the current exact time (calendar) information on the display means 4.

Then, processing proceeds further to step S7, and the "receiving succeeded" is displayed on the display means 4. On the other hand, in the case of "not reliable" at step S5, in which case the result is NO, processing proceeds to step S8 at which "inconsistency exists" in the received data is displayed on the display means 4.

In either case at step S5, processing proceeds to step S88 where the receiving history is stored into the receiving history storage section 24 and the processing is ended.

In contrast, at step S3, when a judgment is made by the receiving condition judgment means 23 as to whether or not the received signal is reliable, in the case of "not reliable," in which the result is NO, processing proceeds to step S9 where "failed" is displayed through the receiving operation on the display means 4, and the processing is ended.

In the case of a judgment of NO at step S1, processing proceeds to step S10. A judgment is then made as to whether or not the operation is a forced receiving operation, and in the case of YES, processing proceeds to step S11. The forced receiving operation is performed as a first time and, at step S12 as a result of performing the forced receiving operation, a judgment is made by the receiving condition judgment means 23 as to whether or not the received signal is reliable. In the case of "reliable," where the result is YES, processing proceeds to step S4, after which the processing just described above is performed. In contrast, in the case of NO at step S12, processing proceeds to step S13, the second forced receiving operation is executed and, at step S14, a judgment is made by the receiving condition judgment means 23 as to whether or not the received signal is reliable and, in the case of "reliable." When the result is YES, processing proceeds to step S4, after which the processing is performed as just described. In contrast, in the case of NO at step S14, processing proceeds to step S9, at which the fact that the receiving operation "failed" is displayed on the display means 4 and processing is ended.

In contrast, in the case of NO at step S10, the processing is ended as is.

As described above, because the first receiving method in the time-programmed receiving operation and the second receiving method in the forced receiving operation are set so as to be mutually different, it is possible to make active use of a combination of the time-programmed receiving operation and the forced receiving operation so as to detect a standard radio wave signal including the required time information in a short time with good efficiency and also to limit the power consumption. This enables the achievement of a radio controlled timepiece of high accuracy which properly receives information such as time information or calendar information and the like from a standard radio wave signal with a minimum of receiving operations.

Figure 3:
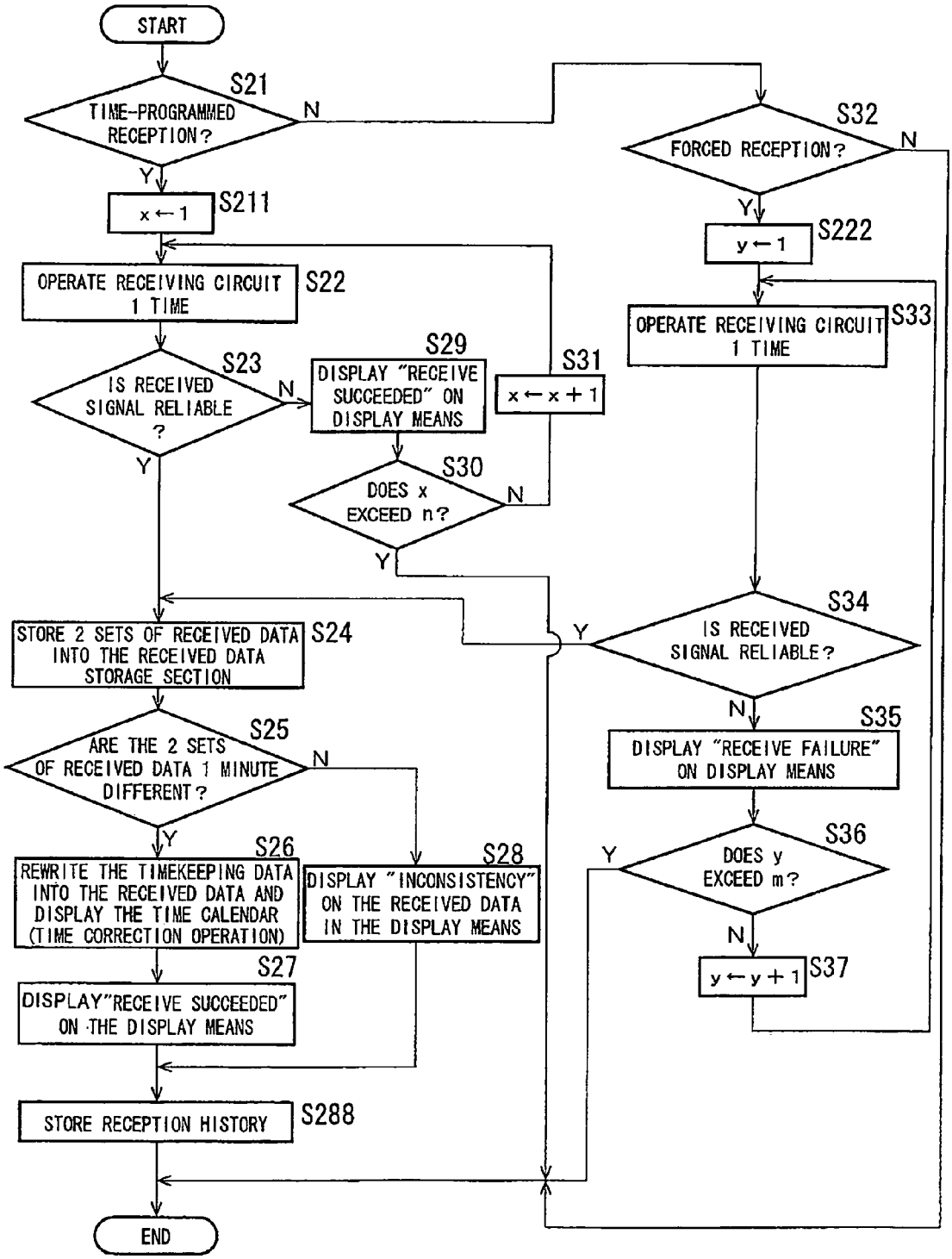
FIG. 3 is a flow chart showing an example of the operating procedure in another specific example of a radio controlled time piece according to the present invention.

FIG. 3 shows an example of the operating procedure in the specific example of the present invention noted above, for the case in which the time-programmed receiving operation causes the receiving circuit 21 to repeatedly operate n times, and in which the forced receiving operation causes the receiving circuit 21 to repeatedly operate m times (where n>than m).

Specifically, after starting, at step S21 a judgment is made as to whether or not the operation is the time-programmed receiving operation and in the case of YES, processing proceeds to step S211 and, "1" is stored at memory x. Processing then proceeds further to step S22 where the time-programmed receiving operation is executed.

Then, at step S23, a judgment is made by the receiving condition judgment means 23 as to whether or not the received signal is reliable. In the case of "reliable," in which the result is YES, processing proceeds to step S24 and the two sets of received data are stored into the received data storage section 6. Then processing proceeds to step S25, and for the purpose of verifying the reliability of the received data, at step S25 "two sets of received data are captured and a judgment is made as to whether the two time and calendar data differ by one minute" is made. If the result is "reliable," this being the result of YES, processing proceeds to step S26. Next, the data in the timekeeping data storage section 5 is overwritten by the data in the received data storage section 6, so as to correct the time (calendar) and display the precise current time (calendar) information on the display means 4. Then processing proceeds further to step S25, and in the case of "not reliable," the result being NO, processing proceeds to step S28, at which "inconsistency exists" in displayed data is indicated on the display means 4.

In either case, at step S25, processing proceeds to step S288, the receiving history is stored into the receiving history storage section 24, and processing is ended.

At step S23 a judgment is made by the receiving condition judgment means 23 as to whether or not the received signal is reliable and, in the case of "not reliable," the result being NO, processing proceeds to step S29 and "failed" for that execution of time-programmed receiving operation is displayed on the display means 4.

Then processing proceeds to step S30 where a judgment is made as to whether or not the contents of memory x, which controls the number of repetitions of time-programmed receiving operation, has exceeded n times and, in the case of NO, processing proceeds to step S31. For the purpose of and in order to execute the next time-programmed receiving operation, the time-programmed receiving operation count x is incremented by 1 (x=x+1) and a return is made to step S22. At step S22, the next time-programmed receiving operation is performed and each of the steps is repeated.

In the case of YES at step S30, processing is ended as is.

On the other hand, after starting, a judgment is made as to whether or not the receiving is time-programmed receiving operation, and in the case of NO, processing proceeds to step S32, at which a judgment is made as to whether or not the operation is forced receiving operation, and in the case of YES, processing proceeds to step S222, at which "1" is stored into memory y, processing proceeding further to step S33 at which forced receiving operation is performed.

Then processing proceeds to step S34 at which a judgment is made by the receiving condition judgment means 23 as to whether or not the received signal is reliable and, in the case of "not reliable," the result being NO, processing proceeds to step S35 at which the fact that the forced receiving operation at that time "failed" is displayed on the display means 4.

Then processing proceeds to step S36 at which a judgment is made as to whether or not the contents of memory y, which controls the number of repetitions of forced receiving operation, has exceeded m times and, in the case of NO, processing proceeds to step S37 and in order to execute the next forced receiving operation. The forced receiving operation count y is incremented by one (y=y+1), after which return is made to step S33, at which the next forced receiving operation is executed, after which the various steps of the above-mentioned forced receiving are repeated.

At step S34 a judgment is made by the receiving condition judgment means 23 as to whether or not the received signal is reliable and, in the case of "reliable," the result being YES, processing proceeds to step S24 after which the processing are as just described.

In the case of YES at step S36, processing is ended as is.

As described above, because the first receiving method in the time-programmed receiving operation and the second receiving method in the forced receiving operation are set so as to be mutually different, it is possible to make active use of a combination of time-programmed receiving operation and forced receiving operation so as to detect a standard radio wave signal including the required time information in a short time with good efficiency and also to limit the power consumption. This achieves a radio controlled time piece of high accuracy which properly receives information such as time information or calendar information and the like from a standard radio wave signal with a minimum of receiving operations.

Figure 4:
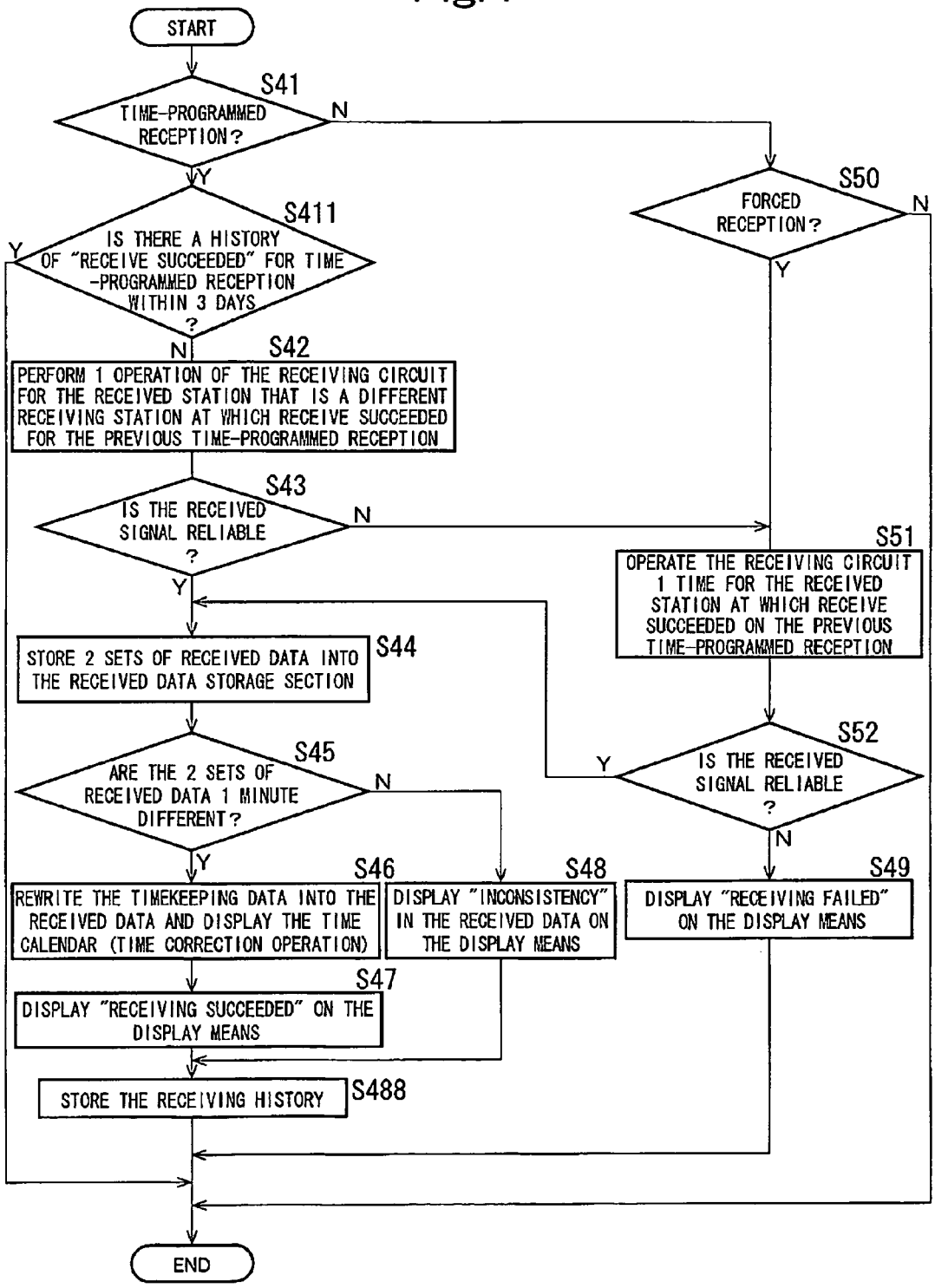
FIG. 4 is a flow chart showing an example of the operating procedure in yet a different specific example of a radio controlled time piece according to the present invention.

Next, an example of the operating procedure in the specific example of the present invention noted above is described below, with reference made to FIG. 4.

Specifically, in this specific example in the programmed receiving operation, when the receiving history of "receiving succeeded" is verified by the receiving history storage section within three days of time-programmed receiving, because there is no problem with regard to accuracy in the radio controlled time piece, the time-programmed receiving operation does not cause the operation of the receiving circuit 21 and does not perform time-programmed receiving, from the standpoint of power consumption.

Additionally, in the case in which there is no history of "receiving succeeded" within three days of time-programmed receiving (that is, receiving failed), reception is first performed from a receiving station that differs from the receiving station at which "the receiving was succeeded" in the most recent time-programmed receiving operation (for example, in the case in which the most recent "receiving succeeded" was a 40-kHz Fukushima station, the Kyushu station, having a frequency of 60 kHz, which is different, is selected). Then, in the case in which "receiving failed" occurs for the different receiving station, receiving is performed from the receiving station at which the "receiving succeeded" was obtained in the most recently performed time-programmed receiving (for example, 40 kHz of the Fukushima station).

This specific example is described in detail below.

After starting, at step S41 a judgment is made as to whether or not the operation is the time-programmed receiving operation and in the case of YES, processing proceeds to step S411, at which a judgment as to whether or not there is a history of "receiving succeeded" within the last three days of time-programmed receiving and, in the case of NO, processing proceeds to step S42, where the receiving circuit 21 is operated one time in the receiving station that is different from the receiving station that resulted in "receiving succeeded."

Then, at step S43, a judgment is made by the receiving condition judgment means 23 as to whether or not the received signal is reliable and, in the case of "reliable," the result being YES, processing proceeds to step S44, at which the two sets of received data are stored into the received data storage section 6. Then processing proceeds to step S45 and, for the purpose of verifying the reliability of the received data, at step 45 "two sets of received data are captured and a judgment is made as to whether there is a difference between the two time and calendar data is one minute" is performed. In the case of "reliable," the result being YES, processing proceeds to step S46, at which the data of the timekeeping data storage section 5 is overwritten by the data of the received data storage section 6, and the time (calendar) correction is performed so as to display the current accurate time (calendar) information on the display means 4. Processing proceeds further to step S47, at which "receiving succeeded" is displayed on the display means 4. On the other hand, in the case of "not reliable" at step 45, this being the result of NO, processing proceeds to step S48, at which a display of "inconsistency exists" in the received data is made on the display means 4.

In either case at step S45, processing proceeds to step S488, the receiving history is stored into the receiving history storage section 24, and processing is ended.

On the other hand, at step S43 at which a judgment is made by the receiving condition judgment section 23 as to whether or not the received signal is reliable, in the case of "not reliable," this result being NO, processing proceeds to step S51, and the receiving circuit 21 is operated one time in the receiving station at which "receiving succeeded" occurred at the previous time-programmed receiving.

Then processing proceeds to step S52, at which a judgment is made by the receiving condition judgment means 23 as to whether or not the received signal is reliable, and in the case of "reliable," this result being YES, processing proceeds to step S44, after which the processing is as described previously, this processing not described again herein.

On the other hand, at step S52, at which the receiving condition judgment means 23 makes a judgment as to whether or not the received signal is reliable, in the case of "not reliable," this result being NO, processing proceeds to step S49, at which the fact that the receiving operation "failed" is displayed on the display means 4.

At step S41, if the result of a judgment is NO, processing proceeds to step S50, a judgment is made as to whether or not the operation is the forced receiving operation and, in the case of YES, processing proceeds to step S51, after which a processing is as just described, the description of this processing omitted herein. On the other hand, in the case in which the judgment is NO at step S50, processing ends.

Also, as another specific example (not illustrated), in the case in which verification is made by the receiving history storage section 24 that there is not a history of "receiving succeeded" within three days of time-programmed receiving, a judgment is made that the radio controlled time piece is in an environment in which receiving is possible, and receiving is first performed from a receiving station at which "receiving succeeded" occurred in the most recently in the past for the time-programmed receiving (for example, the 40-kHz Fukushima station). On the other hand, in the case in which "receiving failed" occurs at the receiving station in which "receiving succeeded" occurred at the previous time-programmed receiving, the reception is next made with a receiving station that is different from the receiving station at which "receiving succeeded" occurred in the immediate previous time-programmed receiving operation (for example, the 60-kHz Kyushu station in the case in which the immediately previous "receiving succeeded" occurred for the 40-kHZ Fukushima station). By doing this, in the case in which a judgment is made that the environment enables receiving, it is possible to achieve greater precision. On the other hand, in the case in which it is not possible to verify by the receiving history storage section 24 that a history of "receiving succeeded" occurred within three days of time-programmed receiving (that is, in the case in which there is no history of "receiving succeeded" within three days of time-programmed receiving, this meaning the case of "receiving failed"), one specific example that can be envisioned is one in which because the probability of "receiving succeeded" if receiving means 2 is operated is low, in order to eliminate unwanted power consumption, the receiving circuit 21 is not operated and the time-programmed receiving operation is not performed. Additionally, in this specific example, in the case in which it is verified at the receiving history storage section 24 that there is a history of "receiving succeeded" within three days of time-programmed receiving, the receiving operation is only performed at a receiving station at which an immediate previous "receiving succeeded" resulted was obtained (for example, the 40-kHz Fukushima station). Even in the case in which "receiving failed" was obtained in a receiving station at which the "receiving succeeded" occurred at the immediate previous time-programmed receiving operation, it is possible to consider a method in which the receiving operation is not performed with a receiving station which is different from the receiving station in which "receiving succeeded" was obtained in immediately previous time-programmed receiving operation (for example, in the case of the 40-kHz Fukushima station having immediately previously resulted in "receiving succeeded," the 60-kHz Kyushu station that is different from the 40-kHz Fukushima station is selected).

As described above, because the first receiving method in the time-programmed receiving operation and the second receiving method in the forced receiving operation are set so as to be mutually different, it is possible to make active use of a combination of time-programmed receiving operation and forced receiving operation so as to detect a standard radio wave signal including the required time information in a short time with good efficiency and also to limit the power consumption, thereby enabling the achievement of a radio controlled time piece of high accuracy which properly receives information such as time information or calendar information and the like from a standard radio wave signal with a minimum of receiving operations.

Next, an example of the operating procedure in the above-noted specific example of the present invention is described below, with reference made to FIG. 5.

Specifically, in this specific example, the receiving station for which the receiving success was obtained in the forced receiving operation, is stored as receiving history information in the receiving history storage section 24, and receiving is performed using time-programmed receiving operation from a receiving station having a high rate of receiving success.

After starting, at step S60 a judgment is made as to whether or not operation is time-programmed receiving and, in the case of YES, processing proceeds to step S61. The receiving station having the highest rate of success, based on the receiving history information in the receiving history storage section 24, is selected, and processing proceeds to either step S62 or step S63. Depending on the results of this selection, a step time-programmed receiving operation is performed from either the first receiving station or second receiving station. Then, at step S64, a judgment is made at the receiving condition judgment means 23 as to whether or not the received signal is reliable and, in the case of "reliable," which is a result of YES, processing proceeds to step S644, and the two sets of received data are stored into the received data storage section 6. Processing proceeds then proceeds to step S65, and for the purpose of verifying the reliability of the received data, at step S65 "two sets of received data are captured and a judgment is made as to whether the difference between the two time and calendar data is one minute" is performed, and in the case of "reliable," this result being YES, processing proceeds to step S66 where the data of the timekeeping data storage section 5 is overwritten by the data in the received data storage section 6, so as to perform correction of the time (calendar) and display the current accurate time (calendar) information on the display means 4. Processing further proceeds to step S67, at which "receiving succeeded" is displayed on the display means 4.

On the other hand, if at step S65 the result is "not reliable," this being the NO result, processing proceeds to step S68, and "inconsistency exists" in the received data is displayed on the display means 4.

Regardless of whether the result at step S65 is YES or NO, ultimately processing proceeds to step S688, at which the receiving history is stored into the receiving history storage section 24 and processing is ended.

At step S64 a judgment is made by the receiving condition judgment means 23 as to whether or not the received signal is reliable and, in the case of "not reliable," this result being NO, processing proceeds to step S69, "receiving failed" is reported for the receiving operation on the display means 4, and processing is ended.

In the case of a judgment of NO at step S60, processing proceeds to step S70. A judgment is made as to whether or not the operation is the forced receiving operation, and in the case of YES, processing proceeds to step S71. Execution of the forced receiving operation is performed at the first receiving station (for example, 40-kHz Fukushima station), and as a result of the forced receiving operation performed at step S72, a judgment is made by the receiving condition judgment means 23 as to whether or not the received signal is reliable. In the case of "reliable," this result being YES, processing proceeds to step S73. The fact that the receiving station at which the receiving succeeded at the first received station (for example, the 40-kHz Fukushima station) is stored into the receiving history storage section 24. After this, processing proceeds to step S644. Because this processing was just described, this processing will not be described again. On the other hand, in the case of NO at step S72, processing proceeds to step S74. Forced receiving operation is performed from the second receiving station (for example, the 60-kHz Kyushu station), and at step S75, a judgment is made by the receiving condition judgment means 23 as to whether or not the signal received as a result of the forced receiving operation is the second receiving station at S75 is reliable. In the case of "reliable," this result being YES, processing proceeds to step S76, and the fact that the successfully received station was the second received station (for example, the 60-kHz Kyushu station) is stored into the receiving history storage section 24. After that, processing proceeds to step S644, and because the processing after step S644 is as just described, it will not be described herein.

On the other hand, in the case of NO at step S75, processing proceeds to step S69, and the fact that the receiving operation "succeeded" is displayed on the display means 4 and processing is ended.

On the other hand, in the case of NO at step S70, processing is ended as is.

As described above, because the first receiving method in the time-programmed receiving operation and the second receiving method in the forced receiving operation are set so as to be mutually different, it is possible to make active use of a combination of time-programmed receiving operation and forced receiving operation so as to detect a standard radio wave signal including the required time information in a short time with good efficiency and also to limit the power consumption. This enables the achievement of a radio controlled time piece of high accuracy which properly receives information, such as time information or calendar information and the like, from a standard radio wave signal with a minimum of receiving operations.

Additionally, in the present invention, it is desirable that in time-programmed receiving operation, which is the first receiving method, a plurality of differing time-programmed receiving operation modes are provided.

Therefore, in the present invention, it is preferable that a plurality of types of time-programmed receiving modes be stored into the time-programmed receiving operation mode storage means 26 beforehand, this being associated with the time-programmed receiving flag 30.

Figure 6:
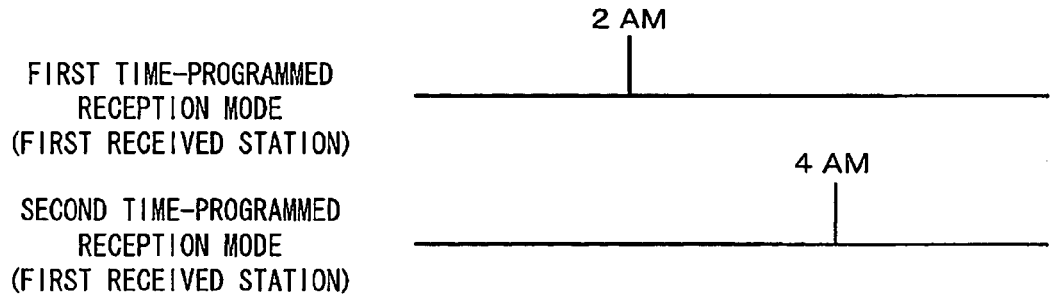
FIG. 6 is a drawing showing an example of the time-programmed receiving operation mode in a specific example of a radio controlled time piece according to the present invention.

For example, as shown in the example of FIG. 6, the first time-programmed receiving operation mode executes one receiving operation at 2 p.m. each day with regard to the first receiving station, and the second time-programmed receiving operating mode executes one receiving operation at 4 a.m. each day with regard to the first receiving station.

Although it is not illustrated, the first time-programmed receiving operation mode executes one receiving operation at 2 a.m. daily with regard to the first receiving station, and the second time-programmed receiving operation mode executes a receiving operation at 2 a.m. one time on the 5th day for the first receiving station. A third time-programmed receiving operating mode executes a receiving operation one time at 2 a.m. on the 20th day, for the first receiving station.

It is also possible to use a time-programmed receiving operating mode configured so as to vary a plurality of receiving times.

Figure 7:
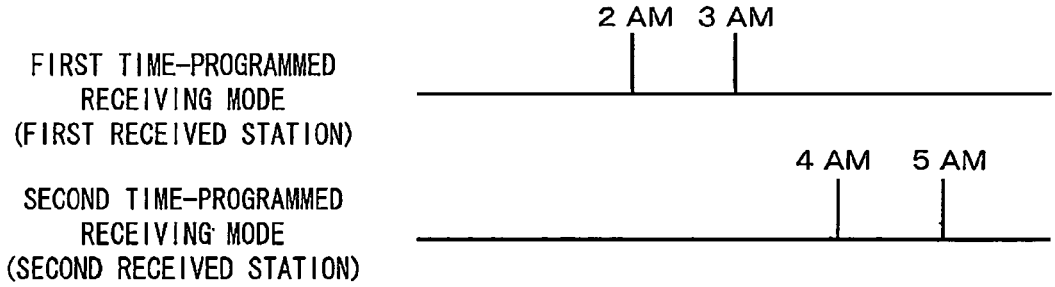
FIG. 7 is a drawing showing another example of the time-programmed receiving operation mode in a specific example of a radio controlled time piece according to the present invention.

Specifically, as shown in FIG. 7, in the first time-programmed receiving operating mode, for example, the setting is made so that receiving is done with the first receiving station at 2 a.m. and 3 a.m., and in the second time-programmed receiving operating mode, the setting is done so that receiving is done with the second receiving station at 4 a.m. and 5 a.m. early-morning times.

Additionally, in the present invention, it is possible for the first time-programmed receiving operating mode and second time-programmed receiving operating mode to be at least partially different with regard to time-programmed receiving operating execution times.

Figure 8:
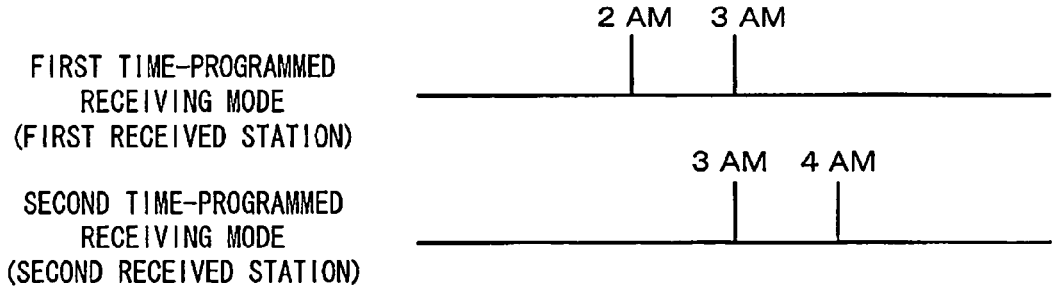
FIG. 8 is a drawing showing yet another example of the time-programmed receiving operation mode in a specific example of a radio controlled time piece according to the present invention.

Specifically, as shown by example in FIG. 8, in the first time-programmed receiving operating mode, for example, the setting is made so that the first receiving station is received at 2 a.m. and 3 a.m., for example, while the second time-programmed receiving operating mode is set so as to receive the second receiving station at, for example, 3 a.m. and 4 a.m.

In a preferred example of the present invention, the configuration is such that, in time-programmed receiving operation, time-programmed receiving operation is only executed in the second time-programmed receiving operating mode in the case in which it is not possible to receive a standard radio wave signal in the first time-programmed receiving operating mode.

Figure 9:
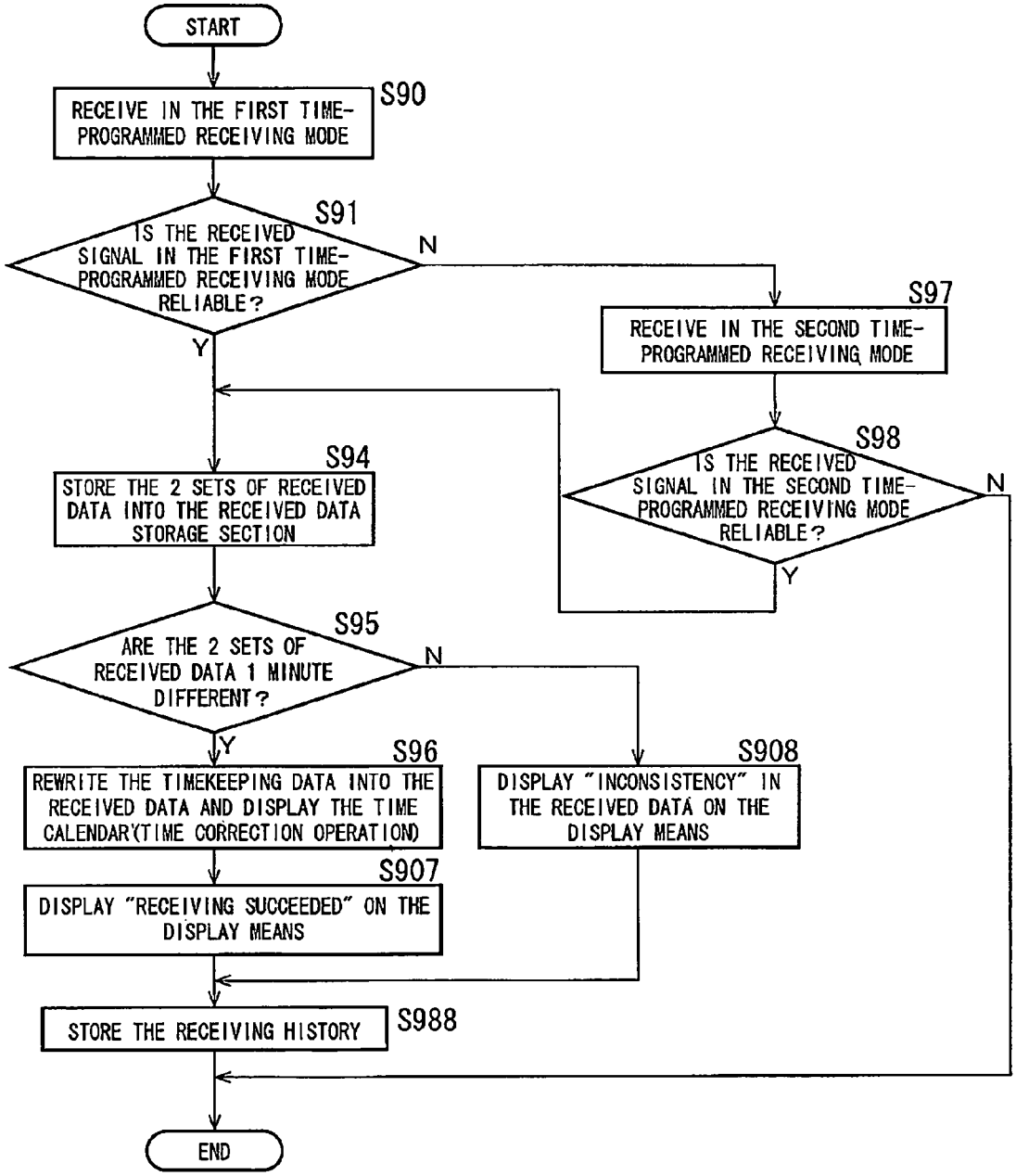
FIG. 9 is a flow chart showing an example of the operating procedure in a specific example of the time-programmed receiving operation mode in a radio controlled time piece according to the present invention.

Next, operation in the above-noted example is shown in the flowchart of FIG. 9.

After starting at step S90, receiving of a standard radio wave signal from a prescribed receiving station is performed by the first time-programmed receiving operating mode. At step S91, a judgment is made by the receiving condition judgment means 23 as to whether or not the received signal in the first time-programmed receiving operating mode is reliable. In the case of "reliable" the result being YES, processing proceeds to step S94, at which two sets of received data are stored into the received data storage section 6. Then, processing proceeds to step S95, and, for the purpose of verifying reliability of a received data, "two received data are captured and a judgment is made as to whether the two time and calendar data differ by one minute" is performed at step S95. In the case of "one minute difference," this result being YES, processing proceeds to step S96, at which the data in the timekeeping data storage section 5 is overwritten by the data in the received data storage section 6 so as to correct the time (calendar) and display the current accurate time (calendar) information on the display means 4 (S5). In the case of "not one minute difference," this result being NO, processing proceeds to step S908, and "inconsistency exists" in the received data is displayed on the display means 4.

Regardless of whether the result at step S95 is YES or NO, processing proceeds to step S988, the receiving history is stored into the receiving history storage section 24, and processing ends.

If, on the other hand, NO occurs at step S91, processing proceeds to step S97, the operation of the receiving the standard radio wave signal from a prescribed receiving station is performed in the second time-programmed receiving operating mode, and at step S98 a judgment is made by the receiving condition judgment means 23 as to whether or not the received signal is reliable. In the case of "reliable," this result being YES, processing proceeds to step S94, after which, because processing is as just described, this processing will not be described herein.

However, if NO results at step S98, processing ends.

This completes the description of FIG. 9.

However, rather than executing the time-programmed receiving operation in the second time-programmed receiving operating mode only when it is not possible to receive the standard radio wave signal in the first time-programmed receiving operating mode as shown in FIG. 9, it is also possible to always execute both the first time-programmed receiving operating mode and the second time-programmed receiving operating mode.

It is preferable to store beforehand into the receiving station storage 27 for time-programmed receiving associated with time-programmed receiving flags one or a plurality of receiving stations.

In time-programmed receiving operation in the present invention, it is possible to contribute to an improvement in the rate of receiving success because of an increase in the number of combinations of receiving operating modes in the time-programmed receiving operation by setting a plurality of receiving stations that can be received beforehand.

In the above-noted specific example of the time-programmed receiving operation in the present invention, in the case in which the receiving condition judgment means 23 makes the judgment, for example, that over a prescribed period of time even though the first time-programmed receiving operating mode was continued, for example, for seven days, it was not possible to receive a standard radio wave signal including prescribed time information, by giving an instruction from the calculation control means 10, based on a control program in the control program storage means 16, it is possible to change the first time-programmed receiving operating mode to the second time-programmed receiving operating mode, and to repeat the above-noted time-programmed receiving operation.

In this case, it is not absolutely necessary that the period of time for the repetition of the time-programmed receiving operation be one and the same with the repeating time period for the first time-programmed receiving operating mode.

Also, in the present invention, it is possible to adopt a configuration in which, during execution of a prescribed time-programmed receiving operating mode and after this time-programmed receiving operating mode, the fact that receiving of a standard radio wave signal including time information failed or, more preferably the number of trials, and trial times are displayed on display means 4.

Additionally, in the present invention, in the case in which it was not possible to receive the standard radio wave signal containing the prescribed time information in the second time-programmed receiving operation mode, by specifying the mode by the calculation control means 10, based on the control program of the control program storage means 16, it is possible to change the second time-programmed receiving operation mode to the third time-programmed receiving mode, in a configuration that repeats the above-noted time-programmed receiving operation.

Essentially, in the present invention, for example, a characteristic is that the configuration is such that it is possible to receive a plurality of types of standard radio wave signals. Such plurality of type of standard radio waves means that the transmitting stations each transmitting the respective standard radio wave signal are differed from each other (receiving station at the side of the radio controlled time piece that receives), and further possibly means in some cases that the frequencies of these standard radio wave signals differ from each other.

Additionally, in the present invention, it is desirable that, in the time-programmed receiving operation, a first time-programmed receiving operation mode and a second time-programmed receiving operation mode are provided, and further that the standard radio wave signals received by the respective time-programmed receiving operation modes differ.

Essentially, in the time-programmed receiving operation, it is preferable that the configuration be such that, only in the case in which it is not possible to receive the standard radio signal in the n-th time-programmed receiving operation mode, a change is made to the (n+1) th time-programmed operation mode so that time-programmed receiving operation is executed by receiving a standard radio wave signal that is different.

Also, in the present invention, it is possible that the configuration is such that a radio wave signal is received from a first receiving station in the first time-programmed receiving operation mode, and a radio wave signal is received from the second receiving station in the second time-programmed receiving operation mode.

Additionally, it is desirable in the present invention that the configuration be such that a radio wave signal having a first frequency is received in the first time-programmed receiving operation mode and a radio wave signal having a second frequency is received in the second time-programmed receiving operation mode.

Furthermore, in the present invention, it is possible, for example, that in the first time-programmed receiving operation mode and in the second time-programmed receiving operation mode, the times for executing the time-programmed receiving operations are, as noted above, the same, and further possible that the times differ.

Also, in some cases, there will be a partial difference in the times for execution of both of the time-programmed receiving operations, or a partial overlap.

Essentially, for example, it is possible in the first time-programmed receiving operation mode, that in the case in which the setting is such that the receiving time is 2 a.m. each time, in the second time-programmed receiving operation mode, it is possible to receive at 4 a.m. each time. The determinations are made appropriately in response to the local environment in which the received radio wave signal is transmitted and the receiving environment for the radio wave signal.

Also, in certain cases, as described with regard to FIG. 8, it is possible to make a setting so that in the first time-programmed receiving operation mode, if the setting is made so that the receiving time is 2 a.m. and 4 a.m. each time, the receiving times are 3 a.m. and 5 a.m. in the second time-programmed receiving operation mode.

It is not necessary in the time-programmed receiving operation that is the first receiving method in the present invention to specify one receiving station to receive a standard radio wave signal including time information. Also, it is desirable that the configuration be such that as to enable individual reception of a plurality of types of standard radio wave signals.

Therefore, for example, a plurality of receiving station information is stored beforehand in the time-programmed receiving station storage section 27 in the time-programmed receiving flag area 30. In the first time-programmed receiving operation mode in the time-programmed receiving operation, the first receiving station information stored in the time-programmed receiving station storage area 27 is selected. This selected receiving station information is sent to the receiving circuit 2 via the receiving station selection means 12, and the standard radio wave signal including the time information transmitted by the prescribed transmitting station is received.

Then, in only the case in which, even after the above-noted plurality of time-programmed receiving operation modes have been completed and the standard radio wave signal including time information has not been able to be received, a different receiving station stored in the receiving station storage area 27 is selected and all of the above-noted plurality of time-programmed receiving operation modes are repeatedly executed with respect to the newly selected second receiving station.

Additionally, as another specific example of the present invention, it is possible to change the receiving station during the time of execution of the plurality of time-programmed receiving operation modes.

For example, it is possible in the first time-programmed receiving operation mode in a time-programmed receiving operation to make a setting so as to receive a standard radio wave signal including time information transmitted from a first receiving station and in the second time-programmed receiving mode to make a setting such that a standard radio wave signal including time information is received that is transmitted from a second receiving station.

For example, domestically in Japan as a standard radio wave signal that includes time information used generally in time correction, there are two locations: a 40-kHz standard radio wave signal transmitted in Fukushima Prefecture (hereinafter JJY40) and a 60-kHz standard radio wave signal transmitted from Kyushu (hereinafter JJY60).

In the US, a standard radio wave signal transmitted from Colorado State is used.

In Germany, a standard radio wave signal called DCF77 transmitted from Frankfurt is used, and in the UK, a standard radio wave signal known as MSF, transmitted from Rugby, is used.

Therefore, it is possible to store a plurality of types of receiving stations as noted above into the above-noted received station storage area 25, and make appropriate selection of the received station.

It is possible, in the present invention to make storage such that the plurality of standard radio wave signals stored into the time-programmed receiving station storage area 27 are each different receiving stations, or have different frequencies.

Essentially, in a preferred specific example of the present invention, in the time-programmed receiving operation, a first time-programmed receiving operation mode and a second time-programmed receiving operation mode are provided and also the receiving radio wave signals in each of these time-programmed receiving operation modes differ.

In the time correction operation in a radio controlled time piece of the present invention, in the case in which, even after a prescribed number of times of the above-noted time-programmed receiving operation or repetition for a prescribed amount of time it is still not possible to receive a prescribed standard radio wave signal, the information is displayed on the display means 4 and notification is given to the user of the radio controlled time piece of this situation. The drive of the receiving means drive means 9 is stopped and the receiving operation is stopped, simultaneously with which the control program in the control program storage means 16 notifies the user of question of "reception failed" in the time-programmed receiving operation. Because in such situations the user must rely on forced receiving operation, the standby condition persists until the forced receiving operation input is made by the user via the external input means 7.

In the case in which there is external input by the user and in which forced receiving operation, which is the second receiving method is executed by the calculation control means 10 processing in accordance with a prescribed program in the control program storage means 16, an appropriate forced receiving operation mode is selected from the one or plurality of forced receiving operation modes stored in the forced receiving operation mode identification storage section 32 associated with the forced receiving operation flag area 31.

Essentially, in the present invention it is desirable that a plurality of mutually different forced receiving operation modes be provided for forced receiving operation in the forced receiving operation.

In the forced receiving operation as well in the present invention, similar to the above-noted time-programmed receiving operation, a forced receiving operation mode is used in which there is mutual difference between the receiving stations, the receiving frequencies, and the number of trial receiving and the like.

Essentially, it is desirable in the forced receiving operation that the configuration is such that one receiving station of a plurality of types of receiving stations is selected, and in making the selection of one receiving station from this plurality of stations, the receiving station is selected by mutually differing operations or by one and the same operations.

In the case of executing the forced receiving operation mode in the present invention, for example, when the user of the radio controlled time piece presses in or pulls out the stem or button and the like provided on part of the time piece or performs a rotational operation thereof, so as to execute the forced receiving operation mode. In the forced receiving operation in the present invention, it is possible to store a plurality of receiving stations into the receiving station storage area 32 beforehand, and for the user to operate an arbitrary external input means 7 so as to select a desired receiving station.

For example, in the embodiment shown in FIG. 10, it is possible to use two types of buttons, the first button being pressed to select the first forced receiving operation mode which receives the first receiving station two times, and the second button being pressed to enable the second forced receiving operation mode in which the second receiving station is received three times.

In the example of FIG. 11, by a pressing operation with respect to a first button the first forced receiving operation mode set so as to receive a first receiving station is enabled, and a pressing operation with respect to the second button enables the second forced receiving operation mode set so as to simply receive the second receiving station is enabled.

Additionally, as shown in FIG. 12, it is possible, by performing a single pressing operation of the first button, to select the first forced receiving operation mode set so as to simply receive the first receiving station. It is possible by a long pressing operation of the first button to enable the second forced receiving operation mode set so as to receive first the first receiving station and then the second receiving station.

Additionally, another preferred specific example in the present invention is one in which the receiving station selected by the forced receiving operation is used as the first receiving station received in the time-programmed receiving operation.

In the forced receiving operation in the present invention, basic manual operation by the user is executed one time, and in the case in which receiving of the standard radio wave signal including time information from a prescribed receiving station succeeds by this one-time forced receiving operation, the forced receiving operation is terminated and, based on control by the calculation control means 10 in accordance with a prescribed control program in the control program storage means 16, the first time-programmed receiving operation mode in the time-programmed receiving operation for which reception of the receiving station succeeded by forced receiving operation is set. Information already stored as the first time-programmed receiving operation mode of the time-programmed receiving operation mode storage means 26 is updated by the above-noted new information.

Essentially, as described above in the forced receiving operation, in general, in each of the forced receiving operation modes, the selection of the transmitting station in the time-programmed receiving operation mode or the like is used. As long as the user does not change his or her location, the receiving station is fixed as one station.

Also, in forced receiving operation in the present invention, a forced receiving operation mode identification storage area 32 and forced receiving station storage area 33 corresponding to the time-programmed receiving operation mode identification storage area 26 and time-programmed receiving station storage area 27 for use in the time-programmed receiving operation are provided within the forced receiving operation flag area 31.

Also, as noted above, in the case in which there are a plurality of time-programmed receiving operation modes, it is possible to receive a radio wave signal from a first receiving station in the first time-programmed receiving operation mode and receive a radio wave signal from a second receiving station in the second time-programmed receiving operation mode. It is also possible in the case in which there are a plurality of forced receiving operation modes in forced receiving operation to receive a radio wave signal from a first radio station in a first forced receiving operation mode and receive a radio wave signal from a second radio station in the second forced receiving operation mode.

In this case, it is possible to receive a radio wave signal having a first frequency in either the first time-programmed receiving operation mode or the first forced receiving operation mode, and to receive a radio wave signal having a second frequency in either the second time-programmed receiving operation mode or the second forced receiving operation mode.

Additionally, in the forced receiving operation in the present invention, the configuration is such that one receiving station is selected from among a plurality of receiving stations. As shown in FIG. 10 through FIG. 12, in selecting one station from a plurality of types of receiving stations, it is possible to provide operation means that differ from each other or that are the same. For example, it is possible that one receiving station is selected by a single pressing of a push button switch, and another receiving station is selected by a continuous push of the same push buttons.

Also, as noted above, it is desirable that the receiving station selected by the forced receiving operation be the first receiving station in both the forced receiving operation and the time-programmed receiving operation.

In the present invention, when the forced receiving operation is performed, it is possible that the method of selecting one station from a plurality of types of receiving stations be one in which based on information in the receiving history storage area 24. A first receiving operation is performed to a station which would be determined a receiving station having the highest receiving success rate and secondly the next receiving operation is performed to a station having the second highest receiving success rate. After that, control is performed in the same manner thereafter from the third and thereafter. Alternatively, it is possible in performing forced receiving operation to use as the method of selecting one station from a plurality of types of receiving stations, a method in which, based on information in a receiving history storage area 24, a receiving operation is performed on only a receiving station judged to have a high receiving success rate. Also, in performing the forced receiving operation that selects one station from a plurality of types of receiving stations, it is possible, based on information in the receiving history storage area 24, to perform the first time-programmed receiving operation on the receiving station judged to have a high receiving success rate, and then to perform the next time-programmed receiving operation at the station having the second highest receiving success rate, and to perform the same type of control from the third and thereafter. This control is a variation of the example described previously in FIG.

5, in which time-programmed receiving operation is performed only on a receiving station judged to have a high receiving success rate based on information in the receiving history storage area 24.

As a selecting operation of the receiving station in addition to the above-mentioned operation of determining the receiving station by establishing a priority sequence referring to the past history of the respective receiving stations that is stored in the receiving history storage means 24, it is possible, for example, to compare the field strengths and set the priority sequence from receiving stations that have high field strength, or to establish the priority sequence by referring to the past history of each one of the receiving stations stored in the receiving history storage means 24, or alternatively, to use a method in which the establishment is done based on the length or shortness of the physical distance between the user location and the location of the receiving station.

For this reason, for example, in the receiving history storage area 24, it is possible to generate data with regard to the frequency of reception in past receiving operations, or with respect to each of the receiving stations to generate data with regard to the number of successes of receiving on the first operation, this being stored into the receiving history storage area 24.

As noted above, it is desirable as an operation that selects a radio wave signal of one frequency from standard radio wave signals having a plurality of frequencies, to use the radio wave signal having a frequency judged as having a high receiving success rate as the first frequency for a receiving operation thereafter.

Essentially, in the present invention, in one specific example, based on the receiving history information for a prescribed period of time over which a plurality of standard radio wave signals are received from a plurality of types of receiving stations, the station would be judged to have the highest receiving success rate within the receiving history information is used as the receiving station received first in subsequent time-programmed receiving operations. It is desirable that, based on the receiving history information for a prescribed period of time for standard radio wave signals that were received and that have a plurality of types of frequencies, the frequency of the standard radio wave signal would be judged to have the highest receiving success rate from within the receiving history information is used as the frequency to be received as the first receiving frequency in the time-programmed receiving operation thereafter.

Additionally, it is possible as a different specific example of the present invention, to have a configuration in which, in the time-programmed receiving operation, the first time-programmed receiving operation mode and the second time-programmed receiving operation mode are always executed, and also possible to have a configuration in which the first time-programmed receiving operation mode is always executed and the second time-programmed receiving operation mode is executed in an overlapped manner at an appropriate timing.

In the present invention, in the time-programmed receiving operation, the configuration can also be one in which only one of the first time-programmed receiving operation mode or the second time-programmed receiving operation mode is repeated.

In the above-noted specific example, in the time-programmed receiving operation, it is possible to adopt a configuration in which one prescribed standard radio wave signal of a plurality of types of standard radio wave signals is, based on receiving history information for a prescribed period of time of receiving a plurality of radio wave signals, a standard radio wave signal judged that has the highest receiving success rate among the receiving history information including those of the time-programmed receiving history information or forced receiving history information in the receiving history storage area 24 as well as the receiving history information summing up with both information.

Figure 13:
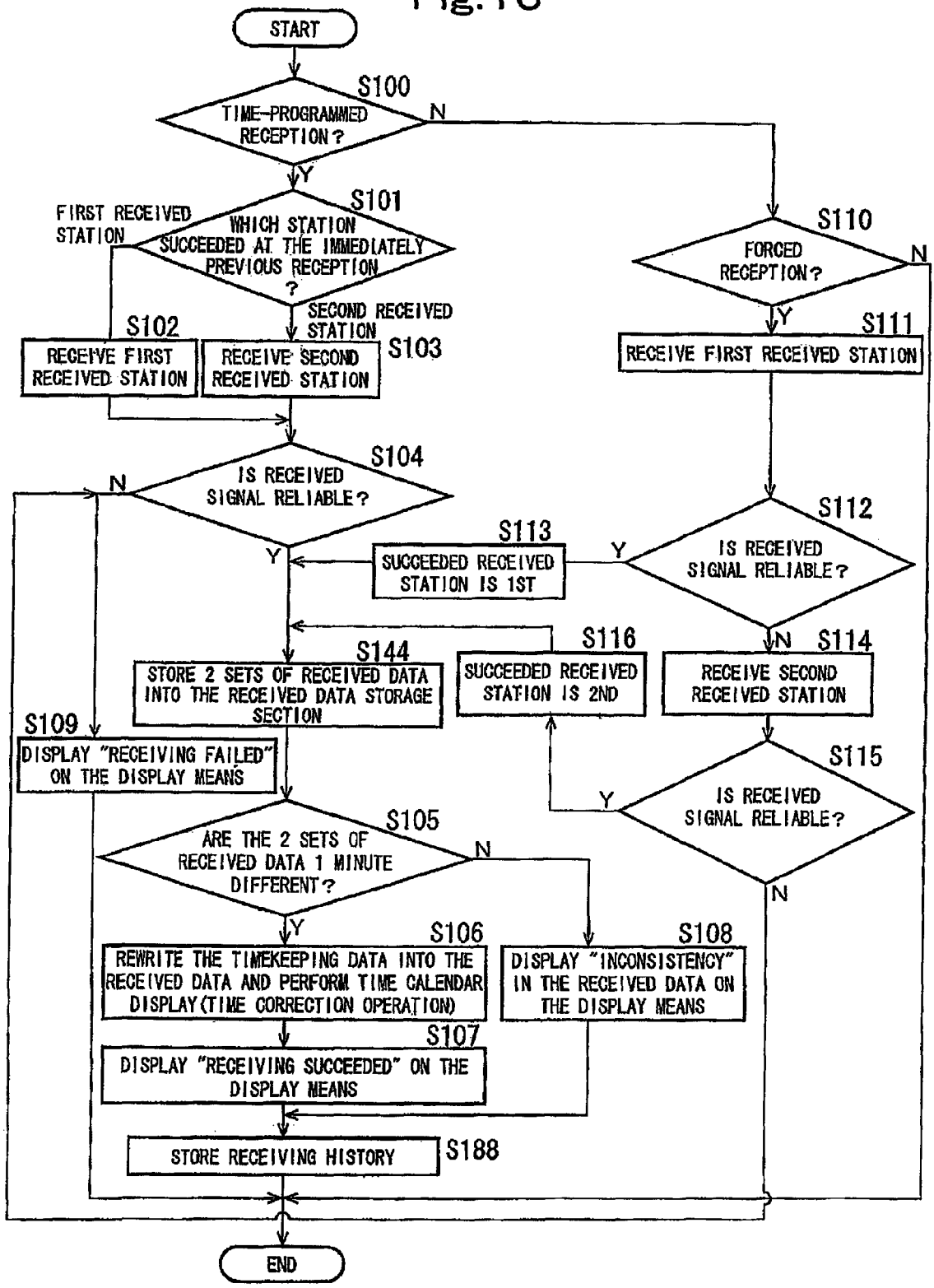
FIG. 13 is a flow chart showing an example of the operating procedure in yet a different specific example of a radio controlled time piece according to the present invention.

Additionally, in yet a different specific example of the present invention, for example, in a radio controlled time piece capable of receiving a plurality of types of standard radio wave signals, a configuration is adopted in which the forced receiving operation performs receiving of a plurality of types of standard radio wave signals. Additionally, the time-programmed receiving operation performs receiving of one prescribed standard radio wave signal of a plurality of types of standard radio wave signals. It is also possible to adopt a configuration in which one prescribed standard radio wave signal of a plurality of standard radio wave signals in the time-programmed receiving operation is a standard radio wave signal for which success occurred on the immediately previous receiving among the plurality of received standard radio wave signals in the forced receiving operation. This specific example is shown in FIG. 13.

Next, this will be described using FIG. 13. After starting, a judgment is made at step S100 as to whether this is the time-programmed receiving operation. In the case of YES, a process proceeds to step S101, at which selection is made of a receiving station for which receiving succeeded on the immediately previous time, based on the receiving history information in the receiving history storage area 24. Based on this selection result, the process proceeds to step S102 or S103 where the time-programmed receiving operation is performed on the first receiving station or the second receiving station. Then, at step S104, a judgment is made by the receiving condition judgment means 23 as to whether the received signal is reliable and, in the case of "reliable," this being the YES result, process proceeds to step S144, at which the two sets of received data are stored into the received data storage area 6. The process then proceeds to step S105 and, for the purpose of verifying the reliability of the received data, "capture of two sets of received data is performed and a judgment is made as to whether the time calendar data of the two are different by one minute" is performed at step S105. In the case of "reliable," this being the result of YES, process proceeds to step S106, at which the data of the timekeeping data storage area 5 is replaced by the data of the received data storage area 6 and correction is performed with time (calendar) and the current accurate time (calendar) information being displayed on the display means 4. Process then proceeds further to step S107, at which a display of "receiving succeeded" is made on display means 4. In contrast, if a "not reliable" result at step S65, this being the NO result, the process proceeds to step S108 and "inconsistency exists" in received data is displayed on the display means 4.

In either the YES or NO case at step S105, the process ultimately proceeds to step S188, at which the receiving history is stored into the receiving history storage area 24 and processing ends.

At step S104, a judgment is made by the receiving condition judgment means 23 as to whether the received signal is reliable. In the case of "not reliable," this being the NO result, process proceeds to step 109, at which "receiving failed" for the receiving operation is displayed on the display means 4 and processing ends.

In the case in which the judgment of NO occurs at step S100, process proceeds to step S110, at which a judgment is made as to whether or not this is the forced receiving operation. In the case of YES, process proceeds to step S111, at which forced receiving operation is performed with respect to the first receiving station (for example, the 40-kHz Fukushima station), and as a result of performing a forced receiving operation at step S112, a judgment is made by the receiving condition judgment means 23 as to whether or not the received signal is reliable. In the case of "reliable," this being the YES result, the process proceeds to step S113, where the fact that the station for which receiving succeeded was the first receiving station (for example, the 40-kHz Fukushima station) is stored into the receiving history storage area 24. After this, the process proceeds to step S144, and because the processing after step S144 is the same as just described, this will be omitted from this description.

On the contrary, in the case of NO at step S112, processing proceeds to step S114, at which forced receiving operation is performed with respect to the second receiving station (for example, the 60-kHz Kyushu station), and, as a result of performing the forced receiving operation on the second received station a judgment is made at step S115 by the receiving condition judgment means 23 as to whether or not the received signal is reliable. In the case of "reliable," this being the YES result, process proceeds to step S116, at which the fact that the station for which receiving succeeded was the second receiving station (for example, the 60-kHz Kyushu station) is stored into the receiving history storage area 24. After this, the process proceeds to step S144, and since processing after step S144 is the same as just described, this will be omitted from this description.

If, however, at step S115 NO resulted, the process proceeds to step S109, at which the fact that the receiving operation "failed" is displayed on the display means 4 and processing is stopped.

In the case, however, of NO at step S110, processing ends as is.

As described above, because the first receiving method in the time-programmed receiving operation and the second receiving method in the forced receiving operation are set so as to be mutually different, it is possible to make active combined use of the time-programmed receiving operation and the forced receiving operation so as to detect a standard radio wave signal containing the required time information in a short period of time with good efficiency, and also to limit the consumption of power, making it possible to achieve a highly accurate radio controlled time piece that properly receives time information or calendar information and the like from a standard radio wave signal with good efficiency by executing a minimum of receiving operations.

A different aspect of the present invention is the time correction method for a radio controlled time piece configured so as to perform time correction based on a standard time information signal by receiving a standard radio wave signal including standard time information signal. This method has a first receiving method step that performs time-programmed receiving operation based on a first receiving method and a second receiving method step performs forced receiving operation based on a second receiving method. When executing the first receiving method step and the second receiving method step either individually or consecutively, the setting is made such that the first receiving method step and the second receiving method step mutually differ. In this time correction method for a radio controlled time piece, it is preferable that the configuration be such that a plurality of types of standard radio wave signals are received, and further it is desirable that, in the forced receiving operation of the second receiving method step, selection is made of one receiving station from a plurality of types of receiving stations.

Essentially, in a more specific configuration of a time correction method for a radio controlled time piece of this aspect of the present invention, the radio controlled time piece is configured so as to receive a standard radio wave signal including a standard time information signal, and perform time correction based on the standard time information signal. This radio controlled time piece minimally has a receiving means, a timekeeping means that keeps time of the time information or calendar information, a display means, a control means that controls the drive condition of the timekeeping means, this being a calculation control means 10, an external input means 7, and a control information storage means 8. Additionally, the time-programmed operation operates when a prescribed timekeeping information value of the timekeeping data storage area 5, which is the timekeeping means, is reached at the predetermined time keeping information value based on the first receiving method and the forced receiving operation that operates by operation of an external input means 7 based on the second receiving method are executed either individually or consecutively. In executing the time-programmed operation, the first receiving method in the time-programmed receiving operation and the second receiving method in the forced receiving operation are set so as to be mutually different.

One specific example of this aspect of the present invention is a time correction method in which the condition of the first receiving method and the second receiving method are set so as to be mutually different. This is a configuration in which the degrees of receiving success of the standard radio wave signal are mutually different. The condition in which the degrees of receiving success of the standard radio wave signal are different is done by causing the number of trial receiving operations for the purpose of receiving a standard radio wave signal is caused to be different.

In a time correction method of the present invention, it is also desirable that, in the time-programmed receiving operation, switching is made to the second time-programmed receiving operation mode and to excuse it, only in the case in which it is not possible to receive the standard radio wave signal in the first time-programmed receiving operation mode.

In the time correction method of the present invention, it is desirable that the configuration be such that the radio controlled time piece receives a plurality of types of standard radio signals. Also preferably, the plurality of types of standard radio wave signals are either from different receiving stations or have different frequencies.

Additionally, in this specific example as well, it is possible in the forced receiving operation to set a plurality of mutually different forced receiving operation modes.

In this specific example, it is possible in a time correction method for a radio controlled time piece in the time-programmed receiving operation to provide a first time-programmed receiving operation mode and a second time-programmed receiving operation mode and also to have a configuration in which the received radio wave signals in each of these modes mutually differ. Additionally, in the time-programmed receiving operation, it is desirable that a first time-programmed receiving operation mode and a second time-programmed receiving operation mode be provided and also that the second time-programmed receiving operation mode be executed only in the case in which it was not possible to receive the prescribed standard radio wave signal in the first time-programmed receiving operation mode.

In the time correction method in the above-noted specific example of a radio controlled time piece of the present invention, it is preferable that in selecting one station from a plurality of types of receiving stations, a receiving station judged to have a high receiving success rate is established as the first receiving station for a receiving operation thereafter. It is preferable that when performing selection of one radio wave signal from standard radio wave signals having a plurality of frequencies, the radio wave signal having a frequency that is judged to have a high receiving success rate is established as the first frequency for subsequent receiving operations.

On the other hand, in the time correction method in the above-noted specific example of the radio controlled time piece of the present invention, it is desirable that the radio wave signal is received from the first receiving station in the first time-programmed receiving operation mode and the radio wave signal is received from the second receiving station in the second time-programmed receiving operation mode. It is also desirable that the radio wave signal having a first frequency in the first time-programmed receiving operation mode is received and the radio wave signal having a second frequency is received in the second time-programmed receiving operation mode.

Additionally, in the time correction method for a radio controlled time piece of the present invention, it is possible to have a configuration in which, in the time-programmed receiving operation, the first time-programmed receiving operation mode and second time-programmed receiving operation mode are always executed. It is also possible in the time-programmed receiving operation to have only one of the first time-programmed receiving operation mode and second time-programmed receiving operation mode repeatedly performed.

In the present invention, the fact that the reliability with regard to the received data from the standard radio wave signal or the judgment of the degree of success in receiving the standard radio wave signal is as noted above. Specific examples thereof were provided, and in the present invention, it will be understood that, with regard to the reliability of the received data of the standard radio wave signal or the judgment with regard to the receiving success rate for the standard radio wave signal there is no restriction to the above-noted specific examples. It is also possible to use a different judgment method or judgment criteria that enables the achievement of the object of the present invention.

A further specific example of the method of judging the reliability of the received data of the standard radio wave signal or the degree of success in receiving the standard radio wave signal is described below.

In general, at the point in time when a standard radio wave signal is received, the reliability of received data of a standard radio wave signal or the degree of success in receiving a standard radio wave signal is individually judged. In the case of an environment in which it is possible to simultaneously use transmitting stations that transmit a plurality of types of standard radio wave signals at a later date utilizing the result of the judgment, a sequence of priority is established with regard to which of these will be the subject of a receiving operation. The actual receiving operation is then performed. This method is known.

However, although this receiving method is effective in the case in which the number of transmitting stations that can be received is somewhat small, in the case in which there is a large number of receivable transmitting stations, it is not possible to make a detailed determination of the receiving priority. Therefore, there are cases in which it is not possible to perform receiving of the ideal transmitting station. That is, because the transmitting station that failed on the immediately previous receiving is made to have the lowest receiving priority, there is a great limitation to the chance that it will be received at the next time. Also, if the receiving priority is simply established by the number of accumulated times that receiving is completed, it is not possible to make a detailed determination of receiving priority that properly reflects the receiving condition of each transmitting station because it is not possible to grasp the ease of receiving of each transmitted station with the presence or nonpresence of intruding noise components and variations and the like in field strength. Also, in the case, for example, in which there exists a plurality of transmitting stations for which the accumulated number of completed receiving is the same, because there is a problem in establishing the receiving priority, even if there are many transmitting stations that transmit a standard radio wave signal, it is desirable that the configuration be made so as to establish the receiving priority by properly selecting the ideal transmitting station and receive with priority a standard radio wave signal of the transmitting station that is ideal for reception.

As a specific example for this purpose, another specific example related to a method of collecting information regarding the reliability or receiving success rate of received data in the present invention is described below while referencing FIG. 14 through FIG. 19.

Figure 14:
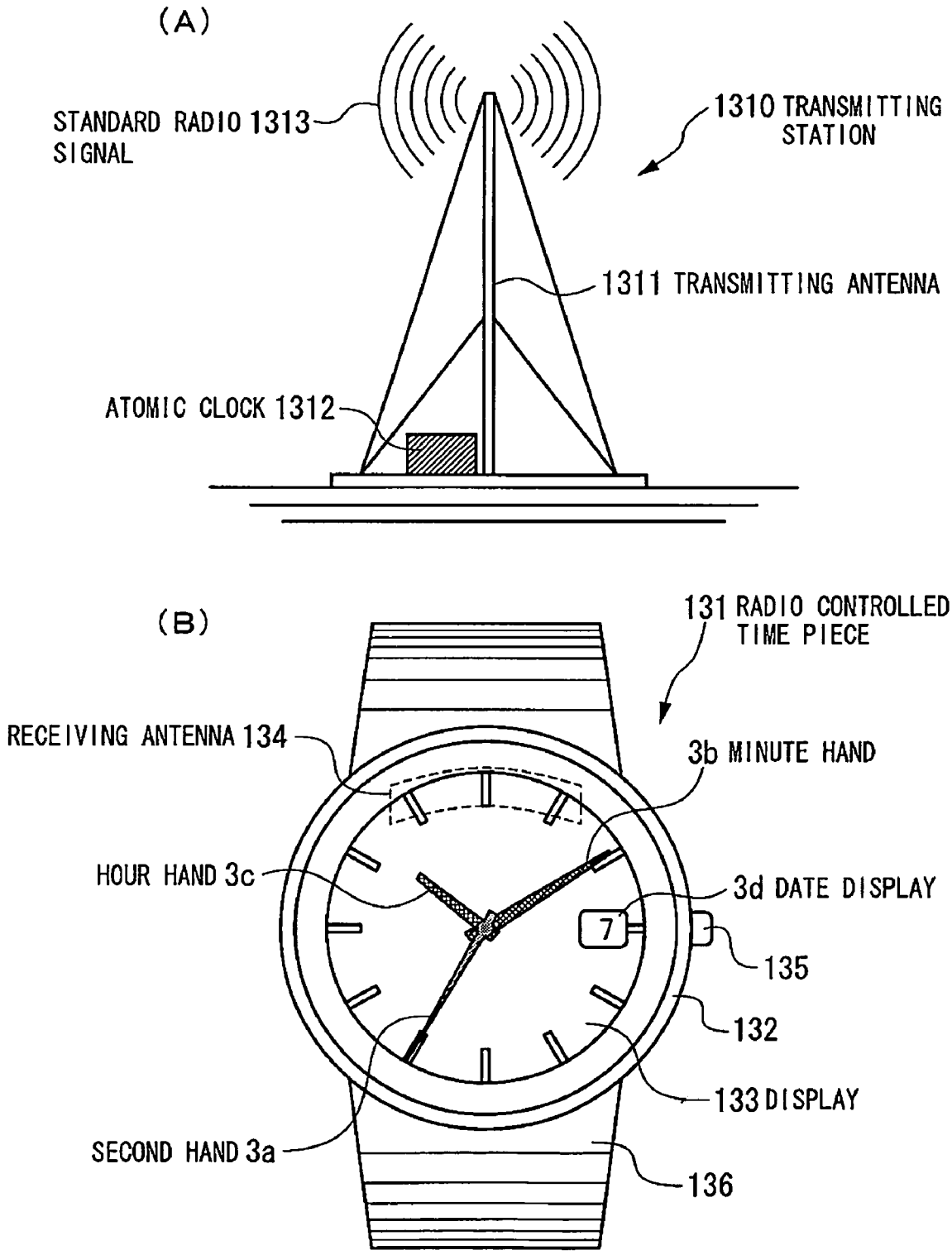
FIG. 14 is a drawing explaining the relationship between a radio controlled time piece according to an embodiment of the present invention and a transmitting station that transmits a standard radio wave signal.

Specifically, FIG. 14 is a drawing that explains the relationship between the radio controlled time piece 131 and the transmitting station 1310 that transmits a standard radio wave signal. In FIG. 14, a radio controlled time piece 131 has an analog display type and an outer case made of metal 132 or the like. The configuration also contains a display 133 serving as the display means which includes a second hand 3*a*, a minute hand 3*b*, an hour hand 3*c*, and a date display that displays the date. An ultra-compact receiving antenna 134 is preferably disposed at the 12 o'clock position within the outer case 132. Also included is a stem 135 that corrects the time and date and a band 136 for the purpose of attachment to the wrist of the user (not illustrated).

A transmitting station 1310 transmits a standard radio wave signal. A transmitting antenna 1311 radiates a standard radio wave signal and an atomic clock 1312 keeps precise standard time. A standard radio wave signal 1313 carries standard time as time information transmitted from the transmitting antenna 1311. The standard radio wave signal 1313 is a long-wave signal that is normally several tens of kilohertz, which can be received over a radius of approximately 1,000-km. Also, the transmitted frequency and time information format of the standard radio signal 1313 is established individually by the transmitting stations in each country or region.

In this case, in order to receive the standard radio wave signal 1313 using the radio controlled time piece 131, as described above, because the receiving antenna 134 is positioned in the 12 o'clock position within the outer case 132, it is preferable that the 12 o'clock position of the radio controlled time piece 131 be pointed in the direction of the transmitting station 1310 and the receiving start button (not illustrated) be pressed. When the radio controlled time piece 131 receives the standard radio wave signal 1313, it performs interpretation using an interpretation algorithm corresponding to the time information format of the standard radio wave signal 1313 to obtain time information such as the second, minute, hour, and date or the like, and when necessary information such as leap year and the existence or nonexistence of Daylight Savings Time. Thus, the obtained time information is time-kept and displayed as the time information and date on the display 133. Also, the receiving of the standard radio wave signal is preferably executed periodically at times such as late at night when there is a good receiving environment with a small amount of noise.

Figure 15:
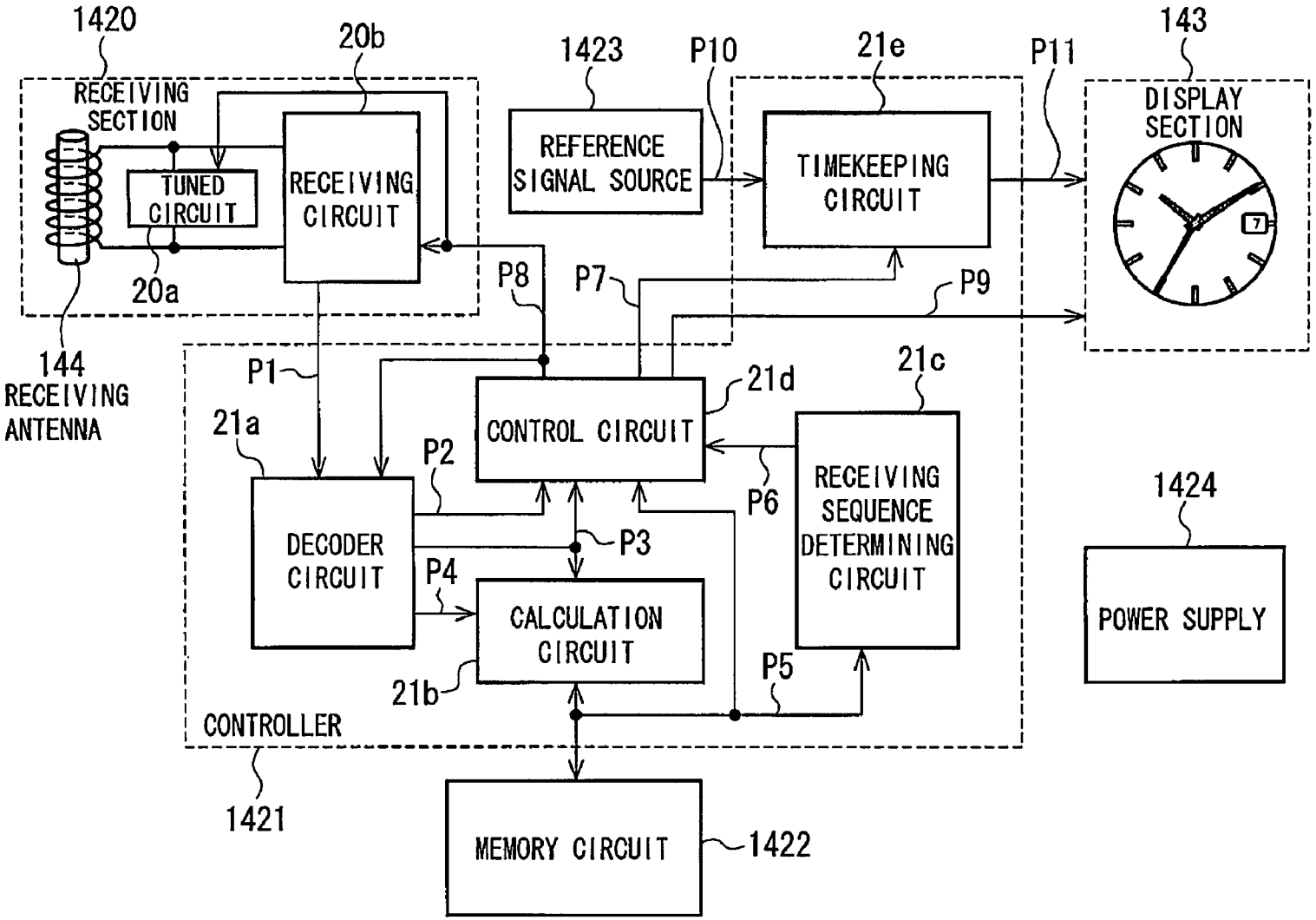
FIG. 15 is a circuit block diagram showing an example of the configuration for the purpose of determining the receiving sequence of receiving stations in a radio controlled time piece according to the present invention.

The above-noted radio controlled time piece 131 has a configuration, for example, such as shown in FIG. 15, that differs from the construction of FIG. 1. This configuration has a receiving means 1420 that selectively receives a standard radio wave signal from a plurality of transmitting stations and outputs a demodulated signal, a decoding means 21*a* that interprets the demodulated signal and outputs time information and received information, a timekeeping means 21*e* that keeps time of the time information from the decoding means 21*a*, a display means 143 that displays the time that is kept by the timekeeping means 21*e*, a storage means 1422 that stores received information from the decoding means 21*a* as receiving history information, a receiving sequence determining means 21*c*, which, based on the receiving history information stored in the storage means 1422, determines the receiving sequence of a plurality of transmitted stations. Also included is a control means 21*d*, which, based on the receiving sequence established by the receiving sequence determining means 21*c*, controls the receiving means 1420 and selects the standard radio signal of the ideal transmitting station for reception.

Also, even if there is a large number of transmitting stations that transmit a standard radio wave signal, in the above configuration, receiving history information is stored in the storage means, and, based on this receiving history information, the receiving sequence is established for each transmitting station. Therefore, it is possible to properly select the ideal transmitting station for receiving.

More specifically, in the block diagram of the above-noted FIG. 15, an appropriate calculation means 21*b* is provided, and, based on the receiving history information stored in the storage means 1422, This calculation means 21*b* calculates the number of times of receiving each received transmitting station and the accumulated receiving processing time. Based on this accumulated receiving processing time and the number of receiving times, the average receiving processing time is calculated and the receiving sequence determining means, based on this average receiving processing time, determines the receiving sequence of a plurality of transmitting stations.

In this specific example, because the receiving sequence of the transmitting stations is determined by the average receiving processing time that is extracted from the number of receiving and the accumulated receiving processing time, it is possible to grasp the detailed receiving condition for each transmitting station and establish the receiving sequence.

Also, the configuration can be one in which the receiving sequence determining means 21*c* determines the receiving sequence for a plurality of transmitting stations based on the combination of the average receiving processing time and number of receiving times for each one of the transmitting station calculated by the calculation means 21*b*.

By doing this, it is possible to achieve a more detailed determination of the receiving sequence since it is possible to determine the receiving sequence for each transmitting station by the combination of the average receiving processing time and number of receiving times.

Additionally, the receiving sequence determining means 21*c* can be configured so as to determine the receiving sequence for a plurality of transmitting stations based on the average receiving processing time for each transmitting station calculated by the calculation means 21*b*. In the case in which the average receiving processing times for each transmitting station is substantially the same for a plurality of transmitting stations, the receiving sequence for a plurality of transmitting stations can be determined, for which the average receiving processing time is substantially equal based on the number of receiving times for each transmitting station calculated by the calculation means 21*b*.

By doing this, even in the case of a plurality of transmitting stations for which the average receiving processing time is the same, because the receiving sequence is determined in accordance with the frequency of number of times of receiving, it is possible to establish the determination of the receiving sequence with more precision.

The receiving sequence determining means 21*c* can be configured such that it determines the receiving sequence for a plurality of transmitting stations based on the number of receiving for each transmitting station calculated by the calculation means 21*b* In the case in which the number of receiving for each of the transmitting stations is essentially the same, the receiving sequence determining means can determine the receiving sequence of a plurality of receiving stations having essentially the same number of receiving times based on the average receiving processing time for each of the transmitting stations calculated by the calculation means 21*b*.

By doing this, even in the case of plurality of transmitting stations having the same number of receiving times, because the receiving sequence is established by the average receiving processing time, it is possible to achieve the establishment of a more precise receiving sequence.

Also, it is possible to adopt a configuration in which the receiving history information stored by the storage means 1422 has receiving level information for a standard radio wave signal of a plurality of transmitting stations received by the receiving means 1420. Further, the calculation means 21*b* calculates the average receiving level for each of a plurality of transmitting stations based on this receiving level information. The receiving sequence determining means 21*c* determines the receiving sequence of the plurality of transmitting stations based on the combination of the average receiving levels and average receiving processing times calculated by the calculation means 21*b*.

By doing this, because the receiving sequence of each transmitting station is determined by the combination of the average receiving level and average receiving processing time that enable a direct grasp of the noise components and field strength variations and the like of the received standard radio wave signal, it is possible to achieve the determination of the receiving sequence with greater precision.

Also, it is possible to adopt a configuration in which the receiving sequence determining means 21*c* determines the receiving sequence of the plurality of transmitting stations based on the average receiving processing time for each transmitting station. This is calculated by the calculation means 21*b*, and in the case in which the average receiving processing times for each transmitting station are substantially the same for a plurality of transmitting stations, determines the receiving sequence of the plurality of transmitting stations having substantially the same average receiving processing time based on the average receiving level for each of the transmitting stations calculated by the calculation means.

By doing this, even in the case of a plurality of transmitting stations having the same average receiving processing time, because the receiving sequence is established by the average receiving level, it is possible to achieve determination of the receiving sequence with greater precision.

Also, it is possible to adopt a configuration in which the receiving sequence determining means 21*c* determines the receiving sequence of a plurality of transmitting stations based on the average receiving level for each transmitting station calculated by the calculation means 21*b*. In the case in which the average receiving level for each of the transmitting stations is substantially the same for a plurality of transmitting stations, the receiving sequence determining means establishes the transmitting sequence of the plurality of transmitting stations having essentially the same average receiving level based on the average receiving processing time for each of the transmitting stations calculated by the calculation means 21*b*.

By doing this, even in the case of a plurality of transmitting stations having the same average receiving level, because the receiving sequence is established by the average length of receiving processing time, it is possible to achieve the determination of the receiving sequence with greater precision.

The display means 143 can be configured so that, based on the transmitting station that is received by the receiving means 1420 in the last receiving operation or the receiving sequence that is established by the receiving sequence determining means 21*c*, the transmitting station having a priority to be received thereafter or that is currently being received by the receiving means is displayed.

As a further description of the configuration of the circuit blocks of the radio-signal corrected watch number one of FIG. 15, in FIG. 15, included is a receiving section 1420 serving as a receiving means. This is formed by a receiving antenna 144 and a tuned circuit 20*a* formed by the receiving antenna 144 that receives the standard radio wave signal and a capacitor for the purpose of receiving the selected standard radio wave signal that is tuned with the receiving antenna 144. Also included is a receiving circuit 20*b* having the functions of amplifying, filtering and detection and the like. The receiving circuit 20*b* inputs and amplifies and detects the weak standard radio signal that is received by the receiving antenna 144 and the tuned circuit 20*a*, and outputs the demodulated signal P1, which is digitized.

Also, 21*a*, as noted above, is a decoder circuit as a decoding means, which inputs and interprets the time information format of the demodulated signal P1 by means of an interpretation algorithm stored therewith. The algorithm outputs the standard time data P2 as the second, minute, hour, and date and the like. Additionally, the algorithm outputs the received information signal P3 as received information having a receiving success/failure flag and a receiving processing in progress flag.

The decoder circuit 21*a* performs digital processing of noise components and the like that are mixed with the demodulated signal P1, quantifies the received level of the received standard radio wave signal, and outputs the receiving level signal P4 as receiving level information. A calculation circuit 21*b* serves as the calculation means, which inputs the receiving information signal P3 and the receiving level signal P4, encodes the transmitting station of the received standard radio wave signal, encodes the receiving success/failure, keeps time of the received processing time, and performs such processing as encoding of the receiving level information, and outputs the receiving information data P5.

A memory circuit 1422 serves as a storage means that inputs the receiving information data P5 and stores the receiving condition of each received transmitting station as encoded receiving history information. A receiving sequence 21*c* determines a circuit serving as the receiving sequence determining means inputs the receiving history information stored in the memory circuit 142 via the receiving information data P5. The receiving sequence determining means then determines the receiving sequence of the received transmitting station and outputs the receiving sequence data P6. A control circuit 21*d* serves as the control means that inputs the standard time data P2 and outputs the time setting data P7.

Also, the control circuit 21*d* inputs the receiving information P5 and the receiving sequence data P6 and outputs the selection signal P8, which selects the priority transmitting station. The control circuit 21*d* inputs the receiving information signal P3 and makes a judgment of receiving operation success or failure based on the receiving success/failure flag. The control circuit 21*d*, by means of the receiving information data P5 and receiving sequence data P6, outputs the transmitting station display signal P9 that represents the priority transmitting station to be received or the transmitting station currently being received, in accordance with the receiving sequence that is determined by the receiving sequence determining means.

The tuned circuit 20*a* of the receiving section 1420, the receiving section 1420*b*, and the decoder circuit 21*a* input the selection signal P8 from the control circuit 21*d*. The tuned circuit 20*a* switches the selection signal P8 by means of an internal capacitor (not illustrated) and varies the frequency tuned together with the receiving antenna 144 so as to select the standard radio wave signal to be received. Also, the receiving circuit 20*b* switches the circuit constants of the internal filter circuit (not illustrated) and detector circuit (not illustrated) or the like by means of the selection signal P8 so that the weak standard radio signal selectively received by the receiving antenna 144 and tuned circuit 20*a* is amplified and detected.

The decoder circuit 21*a* switches the internal interpretation algorithm described above by means of the selection signal P8 and interprets the time information format of the received standard radio wave signal. A reference signal source 1423 having an internal crystal oscillator (not illustrated), which outputs a reference signal P10. 21*e*, is a timekeeping circuit serving as a timekeeping means that sets the accurate time information by means of the standard radio wave signal by inputting the time setting data P7 and also performs timekeeping by the reference signal P10 and outputs the time display signal P11.

As described earlier, the display section 143 is formed by such elements as the second hand 3*a*, minute hand 3*b*, hour hand 3*c*, and date display 3*d*. The display section 143 has a mechanical transmission mechanism such as a motor and gear train and the like not illustrated, for input of the time display signal P11 and output of time information. Also, if necessary, the display 143 inputs the transmitting station display signal P9 and displays the transmitting station received the previous time, the priority transmitting station that is to be received based on the receiving priority established by the receiving sequence determining circuit 21*c*, or the currently received transmitting station, using the second hand 3*a* and hour hand 3*b* and the like. The display of the transmitting station can also be made, rather than with the second hand 3*a* and minute hand 3*b*, by using a compact liquid-crystal panel or the like, in digital form.

Also included is a primary or secondary cell 1424 or the like that is a power source (not illustrated. The power source supplies electrical power to each circuit block via a power supply line. The decoder circuit 21*a*, calculation circuit 21*b*, receiving sequence determining circuit 21*c*, control circuit 21*d*, and timekeeping circuit 21*e* that are enclosed in the large broken-line box can be configured by a single-chip microcomputer as a control part 21. Further, it is possible to implement each of the functions using firmware.

Although the memory circuit 1422 is configured external to the control section 1421, there is no restriction to this configuration and it is also possible to dispose this within the control section 1421. Also, although the receiving level signal P4 that represents the receiving level information of the standard radio wave signal is generated by digital processing by means of the decoder circuit 21*a*, there is no restriction to this method. It is also possible, for example, to generate this signal using analog processing, based on the field strength and the like of the standard radio wave signal received by the receiving circuit 20*b*.

Next, a specific example of the method for determining the receiving priority sequence for receiving stations in the present invention is described, with references made to the block diagram of FIG. 15.

Specifically, in the radio controlled time piece as one specific example shown in FIG. 15, as a description of the basic operation of this radio controlled time piece, when electrical power is supplied to the various circuit blocks by the power supply 1424 via the power line (not illustrated), the control circuit 21*d* executes initialization processing and initializes each of the circuit blocks.

As a result, the timekeeping circuit 21*e* is initialized to 00:00:00 A.M., and as shown in FIG. 14, the second hand 3*a*, minute hand 3*b*, and hour hand 3*c* of the display 133 move to 00:00:00 A.M., the reference position, in accordance with the time display signal P11. The date display 3*b* also moves to the reference position.

Next, the timekeeping circuit 21*e* is started by the reference signal P10 from the reference signal source 1423. The hand movement of the display 143 is started by the timekeeping display signal P11 from the timekeeping circuit 21*e*. Next, the selection signal P8 is successively output by the control circuit 21*d*, and the receiving section 20 inputs the selection signal P8 and switches the tuned frequency of the received signal. The decoder circuit 21*a* inputs the selection signal P8 and switches the interpreting algorithm, so as to search for standard radio wave signal of a receivable transmitting station. Also, the user may switch the receiving switching of the standard radio wave signal after initialization.

Next, as a result of a search for the standard radio wave signal, when the receiving section 1420 finds a receivable standard radio wave signal, it outputs the associated demodulated signal P1 and the decoder circuit 21*a* interprets the demodulated signal P1 in accordance with the selected interpreting algorithm. When the demodulated signal P1 is completely interpreted, it outputs the standard time data P2, received information signal P3, and receiving level signal P4. At this point, because the demodulated signal P1 obtained by demodulating the standard radio wave signal contains all of the time information within a period of time of one minute, one minute of time is required for the interpretation of the time information.

Also, because it is desirable, in order to increase the precision of interpretation, when an interpretation of the demodulated signal P1 is succeeded continuously two times consecutively, the receiving is considered to be completed and is admitted to be a completion of the receiving operation, the interpreting algorithm of the decoder circuit 21*a* minimally requires a receiving processing time of two minutes in order to complete receiving.

Because of noise that is mixed with the standard radio wave signal and a decrease in field strength or the like, the decoder circuit 21*a* might not complete the interpretation, resulting in an interpretation error, in which case it will repeatedly attempt any number of times to perform the interpreting operation each minute. For this reason, the interpreting algorithm of the decoder circuit 21*a* is provided with a receiving processing time limit required for completion of receiving. In the case in which the interpretation operation is repeated many times and the receiving processing time limit is exceeded, it is judged that receiving failed and the operation of receiving a standard radio wave signal is terminated.

As a result, the length of the receiving processing time for the purpose of interpreting the demodulated signal P1 is an important element in grasping the existence of noise components and the field strength variations and the like of the received standard radio wave signal.

Next, when the receiving is completed and the standard time data P2 is output from the decoder circuit 21*a*, the control circuit 21*d* inputs the standard time data P2 and acquires the required time information which then outputs the time setting data P7 comprising the second data, minute data, hour data, and date data and the like. The timekeeping circuit 21*e* inputs the time setting data P7 and sets this as timekeeping information, timekeeping operation continuing thereafter using this time information as a reference. The calculation circuit 21*b* inputs the received information signal P3 and receiving level signal P4 from the decoder circuit 21*a*, performs the calculation of the receiving processing time and the like as described above, and outputs the receiving information data P5. The memory circuit 22 inputs the received information data P5 and stores it as the receiving history information from the received transmitting station.

FIG. 16 shows an example of the receiving history information for received transmitting stations stored by the receiving information data P5 into the memory circuit 22. Specifically, it is possible to store into the memory circuit the receiving history information for N received transmitting stations. This receiving history information, as illustrated, consisting of the received station names, the amount of receiving processing time required to interpret the demodulated signal P1, and the standard radio wave signal received level and the like.

The receiving information for the first received transmitting station is stored at address 1, but when there is receiving information for the next received transmitting station to be stored, an address at which the information for the previously received transmitting station is stored, is added by 1 so as to shift to the next address 2, and the receiving information for the newly received transmitting station is always stored at address 1. Also, when the number of received transmitting stations exceeds N, the receiving information for the (n+1)th time can be deleted, or N can be selected as an arbitrary value in response to the storage capacity of the memory circuit 22.

In FIG. 16 the number of receptions of transmitting stations that has been received is a total of 12. As an example, the associated transmitting stations are JJY Fukushima (Japan), JJY Kyushu (Japan), DCF77 (Germany), and WWVB (US). The oldest receiving information for a received transmitting station is stored at address 12, and the receiving information for the most recently received transmitting station is, as described above, stored at address 1. Address 4 shows an example in which the receiving did not succeed and a receiving error code is stored for the received transmitting station at address 4. It is possible to leave the receiving processing time and receiving level fields blank. Also, the receiving history information stored in the memory circuit 1422 is in actuality encoded data.

Figure 17:
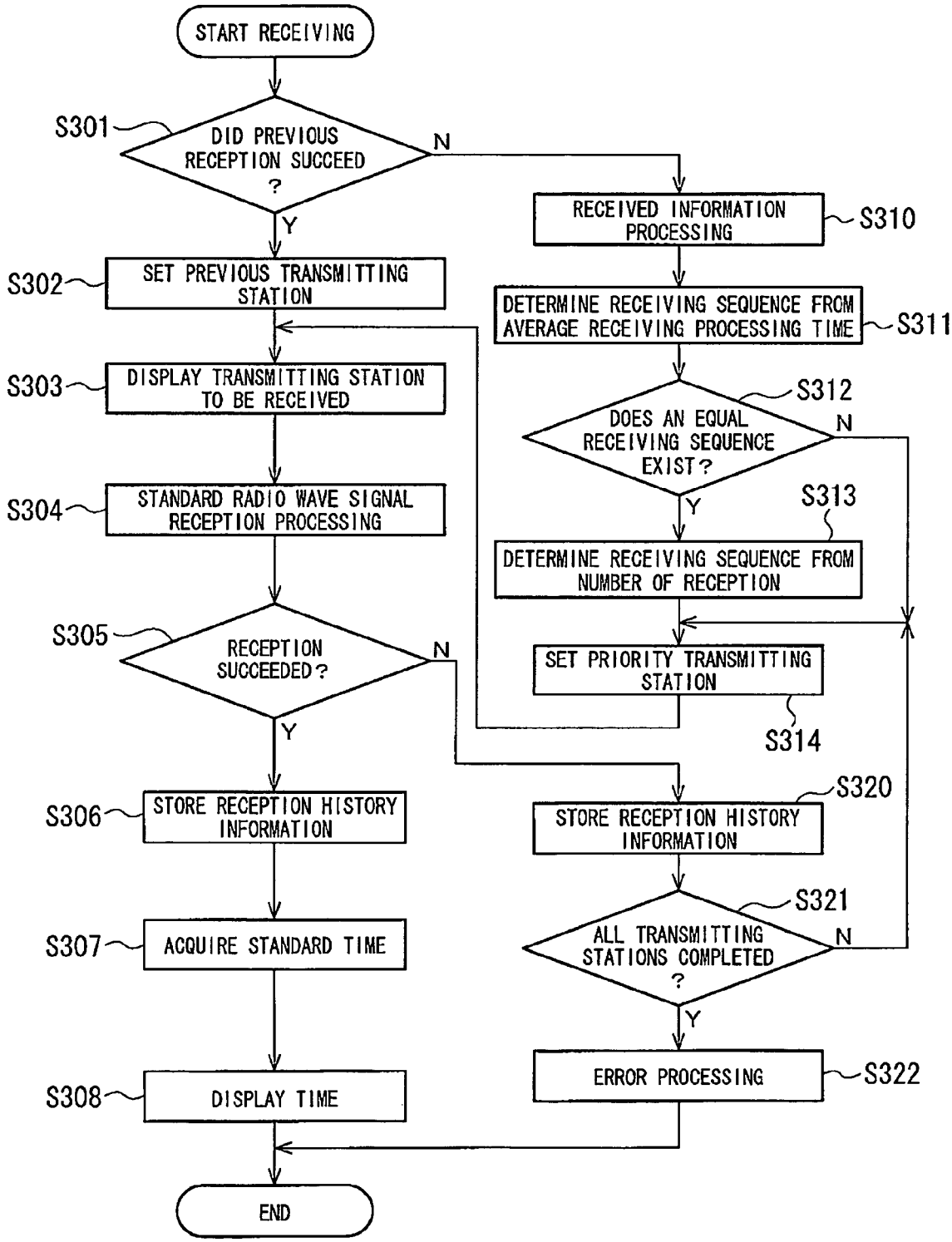
FIG. 17 is a flow chart showing a first specific example of a receiving operation in a radio controlled time piece according to the present invention.

Next, another specific example of the method of receiving sequence determination for receiving stations in the present invention is described based on FIG. 17.

FIG. 17 is a flow-chart showing a receiving operation of one example of the radio controlled time piece of the present invention.

As a premise of explanation, a user of a radio controlled time piece 1 moves to use the radio controlled time piece in many countries in the world including Japan, Germany and U.S. A.

In FIG. 17, when a shift is made to the receiving mode that receives a standard radio wave signal, in response to an operation of the radio controlled time piece 1 by the user or by means of a timer or the like, the control circuit 21*d* first accesses the memory circuit 1422 via the receiving information data P5 and makes a judgment as to whether the immediately previous receiving of the standard radio wave signal succeeded (step S301). At this point, for example, as shown in FIG. 16, the address 1 of the memory circuit 1422 stores the receiving information for the JJY Fukushima station, and if the previous receiving succeeded, processing proceeds to step S302. On the other hand, in the case in which, as shown at address 4 in FIG. 16, the receiving was unsuccessful and a receiving error code is stored at address 4, processing proceeds to step S310.

The following description assumes that the immediately previous receiving succeeded as a premise. The control circuit 21*d* inputs the receiving history information of the immediate previously received transmitting station stored at address 1 of the memory circuit 1422 via the receiving information P5, and identifies the transmitting station for which receiving at the immediately previous step succeeded. And then it outputs a selection signal P8 that indicates the selection of a receiving frequency and an interpreting algorithm, so as to select again the transmitting station that was previously received (step S302). Specifically, using the example of receiving history information shown in FIG. 16, the selection signal P8 selects the frequency and interpreting algorithm for the JJY Fukushima station that was stored at address 1.

Next, the control circuit 21*d*, based on the received selected transmitting station, outputs the transmitting station display signal P9, the display 143 inputs the transmitting station display signal P9, causing the movement of the second hand 3*a*, the minute hand 3*b*, and the like, and display is made of the transmitting station to be received hereafter (step S303). Specifically, in this stage the JJY Fukushima station is displayed.

Next, the receiving section 1420 inputs the selection signal P8, switches the frequency tuned by the tuned circuit 20*a*, and starts receiving the standard radio wave signal of the selected transmitting station. The receiving circuit 20*b* inputs and amplifies the weak standard radio wave signal received by the receiving antenna 4 and the tuned circuit 20*a*, and outputs the digitalized demodulated signal P1. The decoder circuit 21*a* inputs the demodulated signal P1 and, in accordance with the interpreting algorithm selected by the selection signal P8, executes interpreting, and outputs the results of which outputs as the standard time data P2, the receiving information signal P3, and the receiving level signal P4 (step S304).

Next, the control circuit 21*a* inputs the receiving information signal P3 and performs a judgment as to whether the receiving of the selected standard radio wave signal succeeded (step S305). At this point, if the receiving succeeded, processing proceeds to step S306, but if receiving fails, processing proceeds to step S320. After that, processing proceeds to step S306 in accordance with a judgment the receiving has been succeeded.

Next, the calculation circuit 21*b* inputs the receiving information signal P3 and the receiving level signal P4. The calculation circuit 21*b* then performs a calculation processing to encode the received transmitting station and encodes the timekeeping of the receiving processing time and receiving level information and the like. It then outputs receiving information data P5. The memory circuit 22 inputs the receiving information P5 and stores the new receiving history information into the address 1 shown in FIG. 16 (step S306). The receiving information that had been stored in the address 1 of the memory circuit 1422 moved to address 2.

Next, the control circuit 21*d* inputs the standard time data P2, thereby acquiring the required time information, and outputs the time setting data P7 (step S307). In this case, because the display 143 is an analog type display with a second hand 3*a*, a minute hand 3*b*, an hour hand 3*c* and a date display 3*d*, the required time information includes the second, minute, hour, and date data and the like.

Next, the timekeeping circuit 21*e* inputs the time setting data P7 and sets this as the time information. The display 143 inputs the time displaying signal P11, which is the output of the timekeeping circuit 21*e*, and displays the time and calendar information. This ends the receiving operation flow (step S308).

Next, the operation flow in the case in which the receiving failed at the previous time occurs at step S301 (steps S310 to S314) is described. The calculation circuit 21*b* reads out the receiving history information of the received transmitting stations at addresses 1 to N in the memory circuit 1422 and calculates the number of successful receiving of each transmitting station, the accumulated receiving processing time, which is the sum of the receiving processing times therefore, the average receiving processing time, which is obtained by dividing the accumulated receiving processing time by the number of receiving, and the average receiving level, which is obtained by quantizing and accumulating the receiving levels and dividing the resulting value by the number of receiving and stores the results of the receiving information of each transmitting station in a different address of the memory circuit 22 (step S310). The summarization of the receiving information for each transmitting station is known as the histogram receiving information.

FIG. 18 (*a*) shows an example of a histogram receiving information calculated at step S310 and stored in the memory circuit 1422. In FIG. 18 (*a*), there are four transmitting stations that are received, receiving information for the JJY Fukushima station being stored at address 100, receiving information for the JJY Kyushu station being stored at address 101, receiving information for the WWVB station being stored at address 102, and receiving information for the DCF77 station being stored at address 103.

Next, the receiving sequence determining circuit 21*c* reads out the histogram receiving information stored in the memory circuit 1422 via the receiving information data P5 and determines the receiving sequence priority according to the average receiving processing time in the histogram receiving information (step S311). Describing the example shown in FIG. 18 (*a*), the average receiving processing time for the JJY Fukushima station and the JJY Kyushu station, being 4.5 minutes for both, is the shortest, followed by WWVB station at 6.5 minutes, and the longest transmitting station, which DCF77 at 7.0 minutes. As a result, the receiving sequence determining circuit 21*c* establishes the WWVB station as the third receiving sequence and the DCF77 station as the fourth receiving sequence, but cannot determine which of the JJY Fukushima station and JJY Kyushu station should have the highest receiving sequence priority.

Next, at step 312, the receiving sequence determining circuit 21*c* makes a judgment as to whether there is the same receiving sequence determined at step S311. At this point, if there is a transmitting station with the same receiving priority sequence, processing proceeds to step S313, but if there is no transmitting station with the same priority sequence, processing proceeds to step S314. Using the histogram receiving information on FIG. 18 (*a*) as an example, as described earlier, because the receiving sequence is the same for both the JJY Fukushima station and the JJY Kyushu station, at this point, the processing proceeds to step S313.

Next, the receiving sequence determining circuit 21*c* accesses the histogram receiving information that is stored in the memory circuit 1422 and establishes the receiving sequence from the number of successful receiving of the transmitting stations having the same receiving sequence (step S313). In this case, in FIG. 18 (*a*), if a comparison is made between the JJY Fukushima station and the JJY Kyushu station, these having the same receiving sequence, because the number of successful receiving of the JJY Fukushima station has 10 times and the JJY Kyushu station has seven times, the JJY Fukushima station is established as the first priority receiving sequence and the JJY Kyushu station is established as the second priority receiving sequence. As a result, the receiving sequence for all the transmitting stations received is determined by the receiving sequence determining circuit 21*c*, this receiving sequence being stored in the internal memory (not illustrated) of the receiving sequence determining circuit 21*c*.

Next, the control circuit 21*d* inputs the highest receiving sequence stored in the receiving sequence determining circuit 21*c* by the receiving sequence data P6, and outputs a selection signal P8 that indicates the selection of an interpreting algorithm for the purpose of interpreting the time information format at the receiving frequency of the selected station, thereby establishing the priority of the transmitting station to be received (step S314). Specifically, in this case, based on the histogram receiving information of FIG. 18 (*a*), the JJY Fukushima station is established as the highest receiving sequence and the selection signal P8 is output.

Next, the control circuit 21*d* proceeds to step S303 and performs display of the transmitting station to be received, and because the processing after step S303 is duplicated, it will be omitted from this description. Next, the operational flow (at step S320 to step S322) for the case in which, at step S305, the judgment is made that receiving of the standard radio wave signal of the selected transmitting station did not succeed is described. Because the receiving did not succeed, the control circuit 21*d* stores a receiving error code into address 1 of the memory circuit 1422 (step S320).

Next, the control circuit 21*d* checks the receiving sequence information stored in the receiving sequence determining circuit 21*c* via the receiving sequence data P6, and makes a judgment as to whether or not the receiving of all the transmitting stations specified in the receiving sequence has been executed (step S321). At this point, if receiving of all the transmitting stations has not been completed, return is made to step S314, and if receiving of all transmitting stations has been completed, control proceeds to step S322.

Next, if the receiving operation for all transmitting stations had been completed, the control circuit 21*d* judges that it is not possible to receive the standard radio wave signal and discards the histogram receiving information that was stored into the memory circuit 22, thereby ending the flow of receiving operation (step S322). At step S322, it is alternatively possible, rather than discarding the histogram receiving information, to access it in the next receiving operation processing.

If at step S321 receiving operation for all of the transmitting stations has been completed, the control circuit 21*d* returns to step S314, the receiving sequence information in the receiving sequence determining circuit 21*c* is referenced, the transmitting station to be received next is selected, and the selection signal P8 is output. Because the processing after step S314 is the same operational flow repeated, it will not be described herein.

In the receiving operation flow of the specific example shown in FIG. 17, although the receiving sequence of the transmitting station is first determined at step S311 in accordance with the average receiving processing times of the histogram receiving information, there is no restriction to this operational flow. It is also possible, for example, to determine the receiving sequence of transmitting stations first in accordance with the number of times of successful receiving in the histogram receiving information. Specifically, in this case, at step S311 the histogram receiving information stored in the memory circuit 22 is read out by the receiving sequence determining circuit 21*c*, and the receiving sequence is determined from the number of times of successful receiving.

Next, at step S313, the receiving sequence determining circuit 21*c* reads out the histogram receiving information stored in the memory circuit 1422 via the receiving information data P5, and determines the receiving priority sequence from the average receiving processing times for the stations having the same receiving priority sequence (the WWVB station and DCF77 station in FIG. 18 (*a*)). That is, in FIG. 18 (*a*) because the time is 6 minutes for the WWVB station and 7 minutes for the DCF77 station, the WWVB station is made to be the third priority sequence and the DCF77 station is made to be the fourth priority sequence.

In order to simplify the operational flow, it is also possible to eliminate the steps S312 and S313 and to determine the receiving sequence by referencing only the average receiving processing times from the histogram receiving information. In this case, for transmitting stations having the same receiving priority sequence because of equal receiving processing times, it is possible to uniquely give priority to the station having a lower address in the memory circuit 22. Additionally, it is possible to determine the receiving priority sequence by only referencing the number of times of successful receiving among of the histogram receiving information.

Because the receiving priority sequence is determined from the histogram receiving information in accordance with the average receiving processing time, which enables a grasp of the noise components on the received standard radio wave signal or the field strength variation or the like thereof, or a combination of the average receiving processing time and the number of successful times of receiving, it is possible to achieve determination of a more proper receiving priority sequence by grasping the receiving condition of each one of the transmitting stations, precisely.

In accordance with the above-noted specific example, even if there are many transmitting stations that transmit a standard radio wave signal, because it is possible that the receiving history information of the received transmitting station is stored in a memory circuit and the receiving priority sequence is determined by generation histogram receiving information for each transmitting station, based on the receiving history information, it is possible to use this information to judge the degree or level of receiving success or whether the received signal has reliability.

A specific example of the method of determining the receiving priority sequence in the receiving operation of a standard radio signal in the case in which the user (not illustrated) of the radio controlled time piece 1 moves around various countries of the world, for example between Japan, Germany, and the US, and uses the radio controlled time piece 1 is described below, based on FIG. 19.

Figure 19:
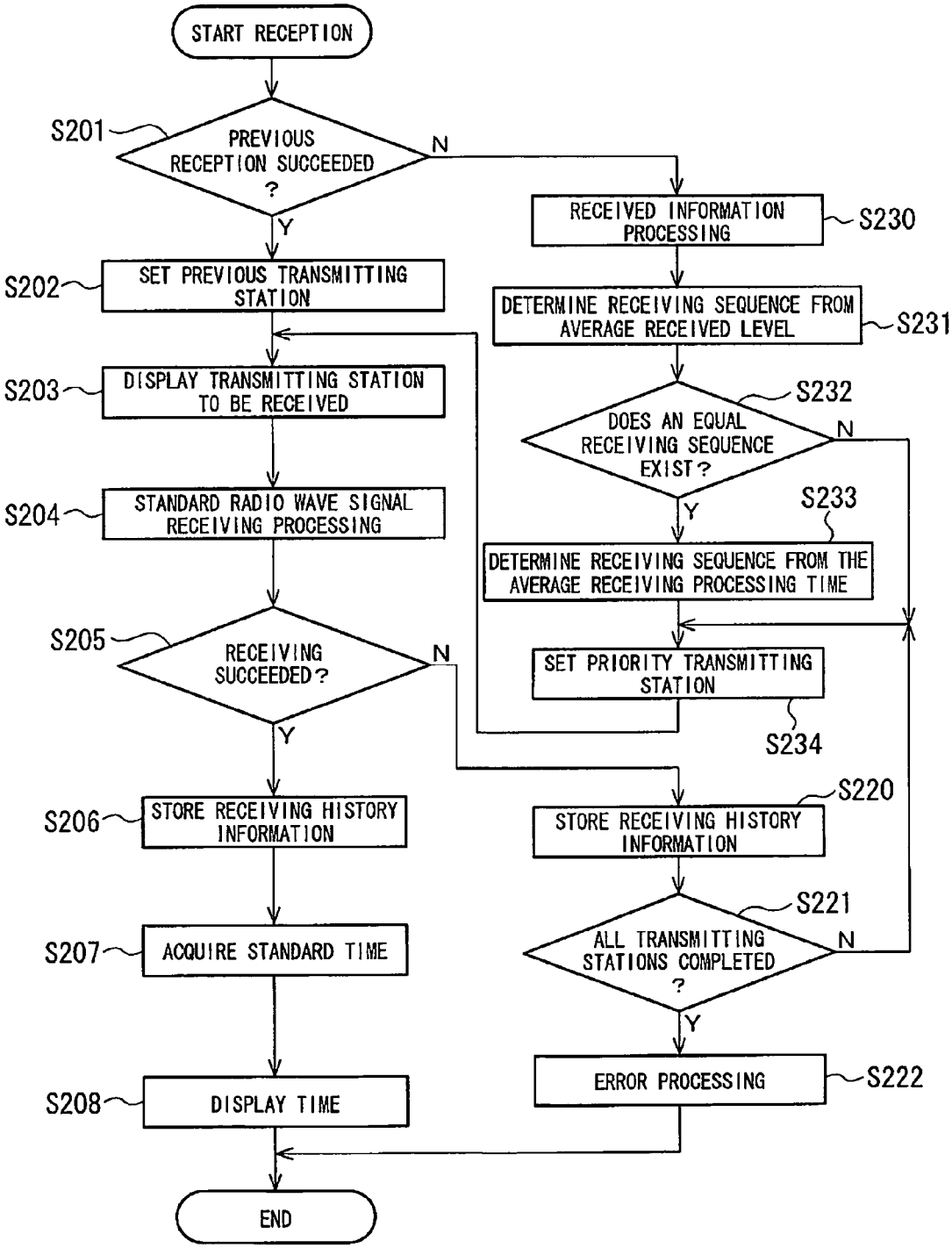
FIG. 19 is a flow chart showing a second specific example of a receiving operation in a radio controlled time piece according to the present invention.

Of the flow shown in FIG. 19, because the operational flow of steps S201 to S208 and S220 to S222 is exactly the same as the flow of steps S301 to S308 and S320 to S322 shown in FIG. 17, the descriptions thereof would be duplications, and are not provided herein.

Specifically, the flow of steps S230 to S234 for "previous receiving failed," which differs from the flow of receiving operation in the specific example of FIG. 17.

The calculation circuit 21*b* reads out the receiving history information of the received transmitting stations stored at addresses 1 to N in the memory circuit 1422 and calculates number of successful receiving times for each transmitting station, the accumulated receiving processing time, which is the total of the receiving processing times, the average receiving processing time, which is obtained by dividing the accumulate receiving processing time by the number of receiving times, the mean receiving processing time, which is obtained by dividing the accumulated receiving processing time by the number of receiving times, and the average receiving level, which is obtained by quantizing and summing the receiving levels and dividing the result by the number of receiving times, and stores receiving information for each transmitting station as histogram receiving information into separate addresses of the memory circuit 1422 (step S230).

FIG. 18(*b*) shows an example of storing the histogram receiving information calculated in step S230 into the memory circuit 1422. In FIG. 18(*b*), there are four transmitting stations, the JJY Fukushima station being stored at address 100, the JJY Kyushu station being stored at address 101, the WWVB station being stored at address 102, and the DCF77 station being stored at address 103.

Next, the receiving priority sequence determining circuit 21*c* reads out the histogram receiving information stored in the memory circuit 1422 via the receiving information data P5 and determines the receiving priority sequence in accordance with the average receiving levels of the histogram receiving information (step S231). Describing the example shown in FIG. 18(*b*), the average receiving level of the JJY Fukushima station is the highest receiving level of "H", the average receiving levels of both the JJY Kyushu station and the WWVB station are "M", and the DCF77 station has the lowest receiving level of "L". As a result, the receiving priority sequence determining circuit 21*c* makes the receiving priority sequence of the JJY Fukushima station the highest, first priority, and makes the receiving priority sequence of the DCF77 station the lowest, fourth priority, but is unable to make a judgment as to whether the JJY Kyushu station or the WWVB station should have priority.

Next, the receiving priority sequence determining circuit 21*c* makes (at step S232) a judgment as to whether or not there are equal receiving priority sequences determined at step S231. If there are transmitting stations having the same receiving priority sequence, processing proceeds to step S233, and if there are no transmitting stations of the same receiving priority sequence, processing proceeds to step S234. Using the example of the histogram receiving information of FIG. 18(*b*), as described above, because the JJY Kyushu station and the WWVB station have the same receiving priority sequence, the processing proceeds at this point to step S233.

Next, the receiving priority sequence determining circuit 21*c* accesses the histogram receiving information stored in the memory circuit 1422 and determines the receiving priority sequence from the average receiving processing times of the transmitting stations having the same receiving priority sequence (step S233). In the case of FIG. 18(*b*), if the average receiving processing times of the JJY Kyushu station and the WWVB station, which have the same receiving priority sequence, are compared, because the JJY Kyushu station is 5.0 minutes and the WWVB station is 6.0 minutes, the JJY Kyushu is given the higher, second, priority, and the WWVB station is given third priority. As a result, the receiving priority sequence of all the receiving transmitting stations is determined by the receiving priority sequence determining circuit 21*c*, these being stored in an internal memory (not illustrated) of the receiving priority sequence determining circuit 21*c*.

Next, the control circuit 21*d* inputs the information stored in the receiving priority sequence determining circuit 21C for the transmitting station having the first priority, via the receiving sequence data P6, and outputs the selection signal P8 that instructs the selection of an interpreting algorithm for the purpose of interpreting the receiving frequency and time information format of the transmitting station to be received, so as to establish the priority transmitting station to be received (step S234). In this case, based on the histogram receiving information in FIG. 18(*b*), the JJY Fukushima station, with the first receiving priority sequence, is selected and the selection signal P8 is output.

Next, the control circuit 21*d* proceeds to step S203 and performs display of the transmitting station to be received, but since the description of the flow after step S203 would be a repetition of the receiving operation flow an earlier described example, it will not be repeated herein.

Although in the receiving operation flow shown in the example of FIG. 19 the receiving priority sequence of transmitting stations is first determined by the average receiving levels of the histogram receiving information at step S231, there is no restriction to this operational flow, and it is also possible to first make the determination of the receiving priority sequence by the average receiving processing times in the histogram receiving information.

Specifically, in that case the receiving priority sequence determining circuit 21*c* would read out the histogram receiving information stored in the memory circuit 1422 at step S231, and would determine the receiving priority sequence from the average receiving processing times.

Next, at step S233 the receiving priority sequence determining circuit 21*c* reads out the histogram receiving information stored in the memory circuit 1422 via the receiving information data P5, and determines the receiving priority sequence from the average receiving levels of the transmitting stations having the same receiving priority (that is, of the WWVB station and the DCF77 station in FIG. 18(*b*)). That is, in FIG. 18(*b*), because the average receiving level of the WWVB is "M" and the average receiving level of the DCF77 station is "L", the WWVB station is given the third receiving priority sequence and the DCF77 is given the fourth receiving priority sequence.

Also, to simplify the operational flow, it is possible to eliminate the steps S232 and S233 and to determine the receiving priority sequence by referencing only the average receiving levels from the histogram receiving information. In this case, for transmitting stations having the same receiving priority sequence, it is possible to uniquely give priority to the station having a lower address in the memory circuit 1422. Additionally, it is possible to determine the receiving priority sequence of the transmitting stations to be received by using the combination of the three elements from the histogram receiving information shown in FIG. 18. These elements are the number of receiving successes, the average receiving processing time, and the average receiving level.

The number of times of receiving in the histogram receiving information shown in FIG. 18 is not restricted to the number of times that receiving succeeded, but also includes the number of unsuccessful receiving times.

According to the above-described specific example as shown in FIG. 19, even if there are many transmitting stations that transmit a standard radio signal as mentioned above, because the receiving history information of the received transmitting station is stored in a memory circuit and the receiving priority sequence is determined by generation histogram receiving information for each transmitting station, based on the receiving history information, it is possible to use this information to judge the degree or level of receiving success or whether the received signal has reliability.

In the radio controlled time piece and the time correction method of the present invention, in performing singularly or consecutively a time-programmed receiving operation that operates when a prescribed timekeeping value of the timekeeping means is reached, based on a first receiving method and a forced reception operation which operates by the operation of the external input means, based on a second receiving operation method, since the first receiving method of time-programmed receiving operation and the second receiving method of forced receiving operation are established so as to be mutually different, by positively making use of a combination of time-programmed reception operation and forced reception operation directing to a standard radio wave signal, thereby properly receiving therefrom, with a minimal receiving operation, the time information and calendar information and the like from a standard radio wave signal with good quality, a radio controlled time piece with high accuracy and the ability to correct the time can be obtained.

In addition to the above-noted configuration, in the case in which a configuration is adopted which enables the receiving of a plurality of types of standard radio wave signals, when a user moves from a region (or country) in which it is possible to receive a first standard radio wave signal to a different region (or country) in which it is possible to receive a second standard radio wave signal, it is possible to detect a standard radio wave signal that includes the required time or calendar information with high efficiency and in a short period of time, and to make combined use of time-programmed receiving operation and forced receiving operation to detect a specific standard radio wave signal including the required timing information, while also suppressing the consumption of electrical power.

By adapting the above-described constitution, the present invention receives a standard radio wave signal that includes time information, and enables, based on the time information, the easy and precise time correction of an electronic watch to the current time.

The invention claimed is:

1. A radio controlled time piece comprising:

a receiving means for receiving a standard radio wave signal including a standard time information signal;

a timekeeping means for keeping time or calendar information;

a display means;

a control means for controlling a drive condition of said timekeeping means;

an external input means; and a control information storage means, wherein:

said receiving means can receive a plurality of types of standard radio wave signals, said radio controlled timepiece performs a time-programmed receiving operation that starts automatically a receiving operation by the receiving means when said timekeeping means reaches a predetermined time information value, and a forced receiving operation that starts the receiving operation by the receiving means when said external input means is operated by a user, and corrects the time or calendar information of the timekeeping means based on time or calendar information acquired from a selected standard radio wave signal when succeeding in receiving the selected standard radio wave signal in the time-programmed receiving operation or in the forced receiving operation, wherein in the time-programmed receiving operation and in the forced receiving operation, said receiving means receives more types of standard radio wave signals in said forced receiving operation than in said time-programmed receiving operation, whereby when an attempt to receive the selected standard radio wave signal in the forced receiving operation is unsuccessful, said receiving means continues to receive the next selected standard radio wave signal unless all the standard radio wave signals have been received, and when an attempt to receive the selected standard radio wave signal in the time-programmed receiving operation is unsuccessful, said receiving means stops the receiving operation.

2. A radio controlled time piece according to claim 1, wherein:

said control means controls said receiving means to receive a single type of standard radio wave signal in said time-programmed receiving operation;

and said control means controls said receiving means to switch and receive a plurality of types of standard radio wave signals in said forced receiving operation.

3. A radio controlled time piece according to claim 2, wherein:

said single type of standard radio wave signal being received in said time-programmed receiving operation is a successfully received standard radio wave signal among a plurality of types of standard radio wave signals received in immediately previous said forced receiving operation.

4. A radio controlled time piece according to claim 3, wherein:

said single type of standard radio wave signal being received in said time-programmed receiving operation is one judged to have the highest rate of successful receiving due to a receiving history information during a predetermined period of time in which a plurality of standard radio wave signals have been received in said forced receiving operation.

5. A radio controlled time piece according to claim 1, further comprising:

a receiving condition judgment means for judging whether a receiving signal output from said receiving means is reliable or not;

wherein:

said control means controls said receiving means so that said receiving means may operate the receiving operation to switch to another type of standard radio wave signal comprised in said plurality of types of standard radio wave signals when said receiving condition judgment means judges that said receiving signal is not reliable when said control means controls said receiving means to receive one type of standard radio wave signal comprised in said plurality of types of standard radio wave signals.

6. A radio controlled time piece comprising:

a receiving means for receiving a standard radio wave signal including a standard time information signal;

a timekeeping means for keeping time or calendar information;

a display means;

a control means for controlling a drive condition of said timekeeping means;

an external input means;

and a control information storage means;

the radio controlled time piece performing a time-programmed receiving operation that operates when said timekeeping means shows a predetermined time information value, and a forced receiving operation that operates when said external input means is operated, wherein:

said control means set the number of trials for operating said receiving means to at least one in the time-programmed receiving operation;

said control means set the number of trials for operating said receiving means, unless the reception succeeds, to a larger number in the forced receiving operation than in the time-programmed receiving operation;

a number of trials of driving said receiving means for receiving said standard radio wave signal in said forced receiving operation may be larger than that in said time-programmed receiving operation, whereby when an attempt to receive the standard radio wave signal in the forced receiving operation is unsuccessful, said receiving means continues to receive the standard radio wave signal again unless the standard radio wave signal has been received a predetermined number of times, and when an attempt to receive the standard radio wave signal in the time-programmed receiving operation is unsuccessful, said receiving means stops the receiving operation.

7. A radio controlled time piece according to claim 6, wherein:

a plurality of mutually different forced receiving operation modes are provided in said forced receiving operation.

8. A radio controlled time piece according to claim 6, wherein:

in said time-programmed receiving operation mode in a case in which there is a history of receiving success in time-programmed receiving operation within a prescribed period of time, a receiving means is not operated at a next time-programmed receiving operation mode, and receiving operation is not performed.

9. A radio controlled time piece according to claim 6, wherein:

in said time-programmed receiving operation an n-th time-programmed receiving operation mode and an (n+1)th time-programmed receiving operation mode are provided, and further wherein the standard radio wave signals received by each of said time-programmed receiving operation modes are mutually different.

10. A radio controlled time piece according to claim 9, wherein:

a radio wave signal from an n-th receiving station is received in said n-th time-programmed receiving operation mode, and a radio wave signal from an (n+1)th receiving station is received, in said (n+1)th time-programmed receiving operation mode.

11. A radio controlled time piece according to claim 9, wherein: a radio wave signal having an n-th frequency is received in said n-th time-programmed receiving operation mode, and a radio wave signal from an (n+1)th frequency is received in said (n+1)th time-programmed receiving operation mode.

12. A radio controlled time piece according to claim 11, wherein:

based on receiving history information of a prescribed period of time of receiving a plurality of types of standard radio waves signals from a plurality of types of receiving stations, a receiving station judged to have the highest rate of successful receiving in said receiving history information is taken as the receiving station to be received first in subsequent time-programmed receiving operation.

13. A radio controlled time piece according to claim 6, wherein: in said time-programmed receiving operation an n-th time-programmed receiving operation mode and an (n+1)th time-programmed receiving operation mode are provided, and wherein a receiving operation is performed in said (n+1)th time-programmed receiving operation mode only in a case in which it is not possible to receive a prescribed standard radio wave signal in said n-th time-programmed receiving operation.

14. A radio controlled time piece according to claim 6, wherein: in said time-programmed receiving operation of receiving, a receiving station selected by said forced receiving operation, is determined as a first receiving station to be received among a plurality of receiving stations.

* * * * *